US008071942B2

(12) United States Patent
Watson et al.

(10) Patent No.: US 8,071,942 B2
(45) Date of Patent: Dec. 6, 2011

(54) SAMPLE HOLDER APPARATUS TO REDUCE ENERGY OF ELECTRONS IN AN ANALYZER SYSTEM AND METHOD

(75) Inventors: David G. Watson, Eden Prairie, MN (US); Paul E. Larson, Bloomington, MN (US); Dennis F. Paul, Eden Prairie, MN (US); Ronald E. Negri, Minnetonka, MN (US)

(73) Assignee: Physical Electronics USA, Inc., Chanhassen, MN (US)

( * ) Notice: Subject to any disclaimer, the term of this patent is extended or adjusted under 35 U.S.C. 154(b) by 114 days.

(21) Appl. No.: 12/705,261

(22) Filed: Feb. 12, 2010

(65) Prior Publication Data

US 2010/0237240 A1 Sep. 23, 2010

Related U.S. Application Data

(60) Provisional application No. 61/161,964, filed on Mar. 20, 2009.

(51) Int. Cl.
*H01J 49/44* (2006.01)
*H01J 49/06* (2006.01)
*G21K 1/00* (2006.01)

(52) U.S. Cl. ..... 250/305; 250/310; 250/396 R; 250/505.1; 250/440.11; 73/864.91

(58) Field of Classification Search ..... 250/305, 250/310, 396 R, 440.11; 73/864.91
See application file for complete search history.

(56) References Cited

U.S. PATENT DOCUMENTS 3,681,600 A * 8/1972 Rigden et al. ..... 250/305
3,699,331 A 10/1972 Palmberg
4,205,226 A 5/1980 Gerlach
5,032,724 A * 7/1991 Gerlach et al. ..... 250/305
6,683,301 B2 * 1/2004 Whitehouse et al. ..... 250/288
7,211,797 B2 * 5/2007 Nishiyama et al. ..... 250/311
7,521,679 B2 * 4/2009 Nishiyama et al. ..... 250/310

FOREIGN PATENT DOCUMENTS

JP 2006-302689 A 11/2006

OTHER PUBLICATIONS

International Search Report and Written Opinion for PCT application PCT/US2010/027580, Jun. 23, 2010. Toburen et al, "The K-, L- and M-Auger and L-Coster-Kronig Spectra of Platinum," *Nuclear Physics*, Jan. 1967; A90(3):529-544.
Watson et al., "High energy resolution Auger spectroscopy on a CMA instrument," *Surf. Interface Anal.*, 2011; 5 pgs. Published online Jun. 13, 2011.

* cited by examiner

*Primary Examiner* — Nikita Wells
(74) *Attorney, Agent, or Firm* — Mueting, Raasch & Gebhardt, P.A.

(57) ABSTRACT

A sample holder apparatus and method for reducing the energy of charged particles entering an annular-acceptance analyzer includes use of an electrically isolated sample support member having a sample receiving surface configured to receive a sample and electrically connect the sample to the sample support member (e.g., wherein the sample support member is configured for application of a retarding bias potential). A grounded sample aperture member defining an aperture relative to the sample support member but electrically isolated therefrom is provided such that the aperture is proximate the sample receiving surface to expose at least a portion of a surface of a sample received thereon to be analyzed (e.g., wherein applying a retarding bias potential to the sample support member produces an electrical retarding field about the aperture that reduces the energy of emitted particles from a sample before they enter an annular-acceptance analyzer).

20 Claims, 16 Drawing Sheets

SAMPLE HOLDER APPARATUS TO REDUCE ENERGY OF ELECTRONS IN AN ANALYZER SYSTEM AND METHOD

CROSS-REFERENCE TO RELATED APPLICATIONS

This application claims the benefit of U.S. Provisional Application Ser. No. 61/161,964 filed 20 Mar. 2009, entitled "Sample Stage Apparatus for Reducing Energy of Electrons in an Annular-Acceptance Analyzer System," which is incorporated herein by reference in its entirety.

BACKGROUND

The disclosure herein relates generally to analyzer systems and methods, e.g., annular-acceptance analyzer systems. More particularly, the disclosure herein pertains to sample holder apparatus for such systems and methods (e.g., that may be mounted on an analyzer instrument stage).

It has long been recognized that the energy resolution of a cylindrical mirror analyzer (CMA), or other analyzers with annular acceptance (whether full 360-degree azimuthal acceptance or partial, that is, less than 360 degree azimuthal acceptance), is determined by the geometry of the analyzer. In such an instrument, $(\Delta E)/E$ is equal to a constant determined by the geometry of the instrument (where E is the kinetic energy of electrons passing through the analyzer in electron·volt (eV) and $\Delta E$ is the energy width (i.e., the analyzer "slit width") or the range of electron energies passed by the analyzer around and at E). Furthermore, it has been recognized that if the energy of electrons entering an annular-acceptance analyzer (such as a CMA) is reduced, the effective resolution of the instrument is increased.

U.S. Pat. No. 3,699,331, entitled "Double Pass Coaxial Cylinder Analyzer with Retarding Spherical Grids," discloses a device and method for reducing the energy of electrons entering a CMA using a retarding grid assembly constructed of two concentric spherical sections. One disadvantage of this approach is the loss in transmission due to two effects. First, the physical transparency (typically 60-90% each) of the grids limits the number of electrons transmitted. Second, when an electric field terminates on a grid of finite mesh, the equipotential surfaces are rippled close to the grid. Each grid opening acts as a lens which causes the transmitted electrons to be scattered from their original trajectory. The effect of grid scattering is to reduce transmission. A second disadvantage of this approach is the aberrations introduced by the non-sphericity of the fine grids (which are easily distorted during manufacture and assembly) and the non-concentricity of the two grid sections. A third disadvantage of this approach is the possibility of grid contamination and consequent need for grid replacement. A final disadvantage of this approach is the necessity of electrically floating the CMA, electron detector, and associated electronics.

Japan Pat. Appl. No. JP2006-302689A, entitled "Auger Electron Spectral Analysis Device and Auger Electron Spectral Analysis Method," discloses a method that applies positive bias voltage to a sample electrode holder and alleges that, with this, kinetic energy of Auger electrons is reduced and high-resolution spectra are obtained.

There exists a need to reduce the energy of electrons entering a CMA without incurring the disadvantages caused by the use of grids for pre-retardation.

SUMMARY

In one or more embodiments described herein, the energy of electrons entering a CMA (or other analyzer with annular acceptance) is reduced without the use of grids. Further, in one or more embodiments, this is accomplished without modification to the analyzer or other critical components of the spectrometer.

Rather, one or more embodiments described herein provide a sample holder apparatus (e.g., mountable on an instrument stage or provided as part of an instrument stage) to reduce the energy of electrons entering an annular-acceptance analyzer (e.g., a CMA) without the use of grids. The sample holder apparatus may include a grounded sample aperture member and an electrically isolated sample support member to which is applied a positive bias potential. The combination of the grounded sample aperture member along with the positive bias potential applied to the sample support member and electrically connected sample produces an electrical retarding field that reduces the energy of the electrons before they enter the analyzer. At least in one or more embodiments, due to the shape of the field, which is substantially planar near the sample surface and substantially spherical farther from the sample surface, the trajectories of said electrons are bent outward from the optical axis such that they fill the entrance to the analyzer and enter with the desired range of input angles.

One or more embodiments of a sample holder apparatus for reducing the energy of charged particles entering an annular-acceptance analyzer (e.g., a cylindrical mirror analyzer (CMA)) described herein includes an electrically isolated sample support member having a sample receiving surface configured to receive a sample and electrically connect the sample to the sample support member. The sample support member is configured for application of a retarding bias potential (e.g., a positive retarding bias). Further, the sample holder apparatus includes a grounded sample aperture member defining an aperture (e.g., a circular aperture), wherein the grounded sample aperture member is positioned relative to the sample support member but electrically isolated therefrom such that the aperture is proximate the sample receiving surface to expose at least a portion of a surface of a sample received thereon to be analyzed. The grounded sample aperture member along with the sample support member are configured to produce an electrical retarding field about the aperture when a retarding bias potential is applied thereto that reduces the energy of emitted particles from a sample before they enter the annular-acceptance analyzer.

In one or more embodiments, the grounded sample aperture member along with the sample support member are configured to produce an electrical retarding field about a circular aperture when a retarding bias potential is applied thereto that reduces the energy of emitted particles from a sample before they enter the annular-acceptance analyzer and further that modifies the trajectories of such emitted particles such that they enter the annular-acceptance analyzer in a predetermined range of input elevation angles.

One or more embodiments of a method for reducing the energy of charged particles entering an annular-acceptance analyzer (e.g., a cylindrical mirror analyzer (CMA)) as described herein may include providing an electrically isolated sample support member having a sample receiving surface configured to receive a sample and electrically connect the sample to the sample support member (e.g., the sample support member is configured for application of a retarding bias potential). Further, the method may include positioning a grounded sample aperture member defining an aperture relative to the sample support member but electrically isolated therefrom such that the aperture (e.g., a circular aperture) is proximate the sample receiving surface to expose at least a portion of a surface of a sample received thereon to be analyzed (e.g., the surface of the sample may be above, flush or below the plane in which the aperture lies). Still further, the method may include applying a retarding bias potential (e.g., a positive bias potential) to the sample support member to produce an electrical retarding field about the aperture (e.g., a retarding field about the aperture that includes a planar portion proximate the surface of the sample to be analyzed and a more spherical portion farther from the surface of the sample to be analyzed) that reduces the energy of emitted particles from a sample before they enter the annular-acceptance analyzer.

In one or more embodiments of the method, applying a retarding bias potential to the sample support member may include applying a retarding bias potential to the sample support member to produce an electrical retarding field about the aperture that reduces the energy of emitted particles from a sample before they enter the annular-acceptance analyzer and further that modifies the trajectories of such emitted particles such that they enter the annular-acceptance analyzer in a predetermined range of input, elevation angles.

One or more embodiments of an analyzer system for use in analyzing a sample are also provided herein. The system may include an analyzer apparatus defining a full or a partial annular-acceptance input opening to receive emitted particles from the sample being analyzed. Further, the system includes an electrically isolated sample support member having a sample receiving surface configured to receive a sample and electrically connect the sample to the sample support member (e.g., wherein the sample support member is configured for application of a retarding bias potential). Still further, the system may include a grounded sample aperture member defining an aperture. At least a portion of the grounded sample aperture member is positioned between the annular-acceptance input opening of the analyzer apparatus and the sample support member such that the aperture is proximate the sample receiving surface to expose at least a portion of a surface of a sample received thereon to be analyzed (e.g., the sample support member is electrically isolated from the grounded sample aperture member). Yet further, the grounded sample aperture member along with the sample support member are configured to produce an electrical retarding field about the aperture when a retarding bias potential is applied thereto that reduces the energy of emitted particles from a sample before they enter the annular-acceptance input opening.

The above summary of the present invention is not intended to describe each embodiment or every implementation of the present invention. Advantages, together with a more complete understanding of the invention, will become apparent and appreciated by referring to the following detailed description and claims taken in conjunction with the accompanying drawings.

BRIEF DESCRIPTION OF THE DRAWINGS

Multiple embodiments of the invention are now described, by way of example only, with reference to the accompanying drawings, of which.

Figure 1:
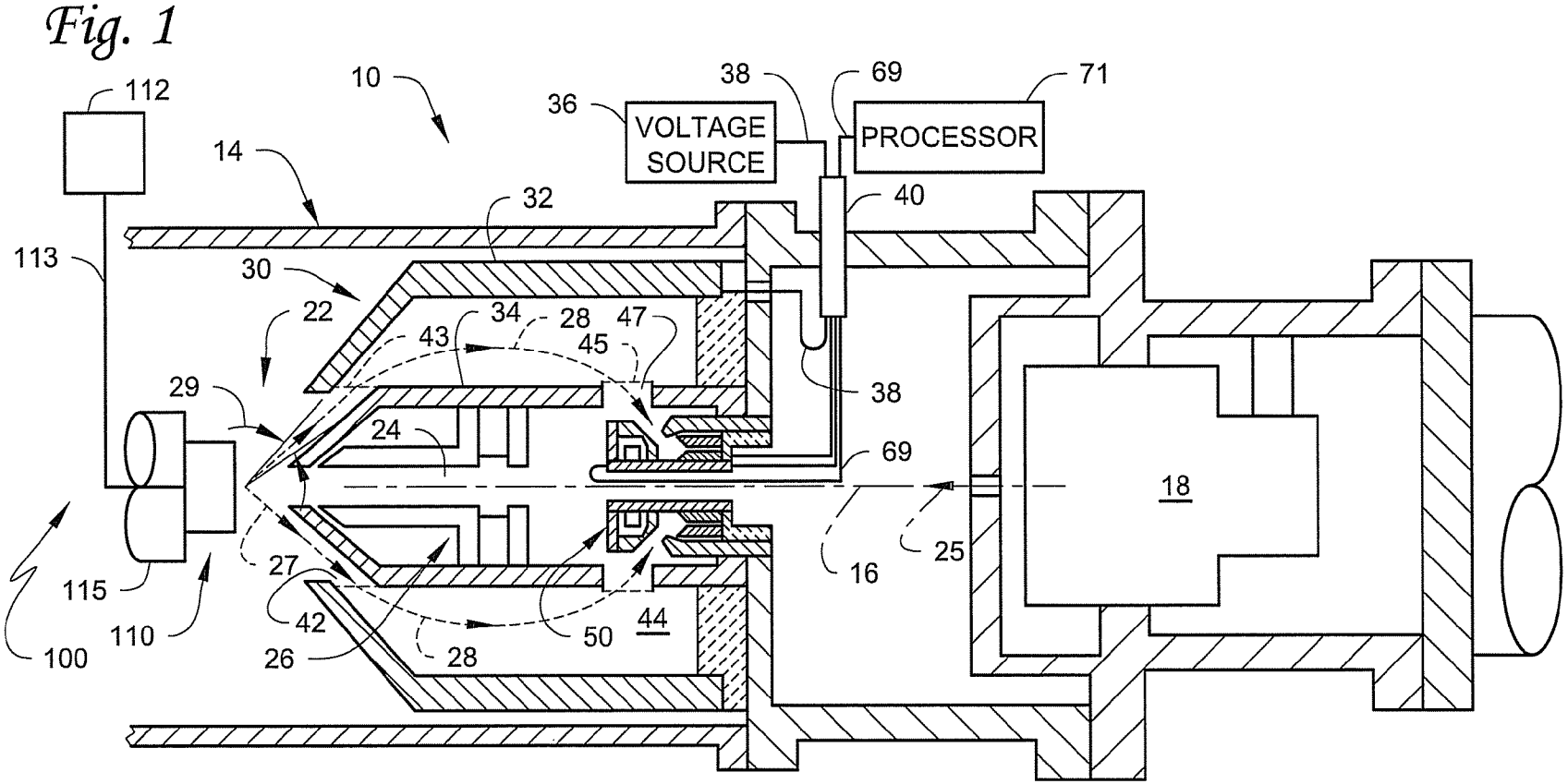
FIG. 1 is an illustrative simplified longitudinal section of an analyzer system including a cylindrical mirror analyzer (CMA) (a type of annular-acceptance analyzer) and incorporating a sample holder apparatus according the present disclosure.

The figures are rendered primarily for clarity and, as a result, are not necessarily drawn to scale.

DETAILED DESCRIPTION OF EXEMPLARY EMBODIMENTS

In the following detailed description of illustrative embodiments, reference is made to the accompanying figures of the drawing which form a part hereof, and in which are shown, by way of illustration, specific embodiments which may be practiced. It is to be understood that other embodiments may be utilized and structural changes may be made without departing from the scope of the disclosure.

In the following description, the polarities of the applied potentials are chosen for the analysis of negatively-charged particles, and in the embodiments of FIGS. 1-14 the charged particles are assumed to be electrons. It will, of course, be appreciated that positively-charged particles may be analyzed by reversing the polarities of the applied potentials.

The present description is with regard to a sample holder apparatus for reducing the energy of electrons entering an annular-acceptance analyzer, such as a CMA. For example, the analyzer may be part of a system used to analyze the chemical state of a solid surface, such as an Auger electron spectroscopy (AES) system. Instrumentation for use in spectroscopy of charged particles makes use of electrons or ions which are emitted from a substance after being bombarded or irradiated with electrons or ions from a source such as an electron gun, e.g., such as in Auger electron spectroscopy. For example, in one embodiment of this technique, a target sample material is placed in a vacuum, and upon being bombarded with electrons from some source, such as an electron gun, the sample gives off a variety of emissions. Among these are X-rays, secondary electrons, and reflected primary electrons from the source. The emissions include Auger electrons (a particular class of secondary electrons) having a distribution of electron energies and a range of particle trajectories.

In the art of Auger electron spectroscopy, as taught for example in U.S. Pat. No. 4,205,226 (Gerlach), instruments making use of cylindrical mirror analyzers ("CMA") are known which analyze the energy and the energy spectrum of Auger electrons emitted by the sample material. Such instruments operate by introducing the diverging electrons into a radial electric field produced between a pair of coaxially mounted electrode cylinders held at different electric potentials. Auger electrons injected from the sample into the radial electric field between the cylindrical electrodes are deflected by the field back toward the common axis of the electrodes. Electrons of a predetermined energy are thereby brought to a focus. By positioning a collector apparatus at this focus, electrons of a predetermined energy are selected and detected. By sweeping the voltage impressed across the cylindrical electrodes through a range of values, and detecting as a function of these applied potentials such electrons as are collected, the energy spectrum of the injected electrons may be plotted and determined.

One or more embodiments of the sample holder apparatus described herein is beneficial to enhance Auger electron spectroscopy energy resolution, or improve the energy resolution of the Auger electron spectrum measured by a cylindrical mirror analyzer (CMA) or any other analyzer with annular acceptance (whether full 360-degree azimuthal acceptance or partial, that is, less than 360 degree azimuthal acceptance). For simplicity herein, when the term CMA is used herein it shall refer to any of such types of analyzers, including those with annular acceptance (whether full 360-degree azimuthal acceptance or partial, that is, less than 360 degree azimuthal acceptance). In other words, even though CMA is a type of annular-acceptance analyzer, the terms CMA and annular-acceptance analyzer are used interchangeably herein. Further, as used herein annular-acceptance or annular-acceptance used with terms such as input, entrance, openings, etc. refers to any annular region or portion of an annular region defined by an analyzer for acceptance of particles to be analyzed (see, for example, the gap 42 defined in CMA 30 of system 10 shown in FIG. 1).

The standard equation, $\Delta E/E=c$, expresses the energy resolution of the analyzer as a ratio involving E, the kinetic energy of electrons passing through the analyzer in electron·volt (eV) and $\Delta E$, the energy width (i.e., the analyzer "slit width") or the range of electron energies passed by the analyzer around and at E; c is a constant determined by the design and operational characteristics of the analyzer and, for a CMA, c is typically about 0.5% by design.

From the energy resolution expression above, it follows that there are two ways to increase the energy resolution. The first is to decrease the constant c of the analyzer. Reduction of the constant c by redesign of the analyzer is to be avoided and, in fact, may not be practical for optical reasons. However, second, if the natural kinetic energy, $E_0$, of electrons of a given spectral feature (peak) can be reduced by a multiplicative factor, f, to kinetic energy $E_f=E_0 \cdot f$ before they enter the analyzer, then the corresponding analyzer energy window, $\Delta E_0$, through which those electrons would pass, is reduced by the same factor to $\Delta E_f=\Delta E_0 \cdot f$ and since $$\Delta E_f/E_f=c$$

then $$\Delta E_f/E_0=c \cdot f=c_f$$

where, $c_f$ is the effective analyzer energy resolution for a spectral feature at natural kinetic energy, $E_0$. Effective analyzer energy resolution means that the Auger spectral feature naturally appearing at energy, $E_0$, will appear in the measured spectrum with the energy resolution that would be achieved had the measurement been made on an analyzer with designed energy resolution, $c_f$ (i.e., the designed energy resolution depending on the design of the instrument).

The reduction in the natural kinetic energy, $E_0$, can be made by applying a positive, DC electrical bias, $V_B$, to the sample, as mentioned above and f is then given by the ratio of the natural and reduced kinetic energies $$f=E_f/E_0$$

where $$E_f=E_0-eV_B$$

and, $V_B$ is the bias voltage, e is the charge on the electron and, in all cases, $eV_B<E_0$.

Meaningful application (e.g., application that results in enhanced analyzer energy resolution) of a positive, DC electrical bias, $V_B$, to the sample can be accomplished using a sample holder apparatus as generally and more specifically described herein.

The energy resolution of the chemical element's measured Auger spectrum is improved by some amount that is dependent on this effect, the natural linewidth of the Auger peak when it is not distorted by any analyzer, and possibly other effects yet to be determined. Note that the energy scale on the measured spectrum must then be shifted back by $+eV_B$ for display purposes, therefore, the bias voltage, $V_B$, must be known accurately, say to less than 0.1 eV.

In other words, a system that uses an applied positive DC electrical bias, $V_B$, to the sample, may include software that is configured to receive an input corresponding to the bias voltage, $V_B$, and then manipulate the data representative of the measured spectrum based on the bias voltage such that the energy scale on the measured spectrum is shifted back by $+eV_B$ and the measured spectrum is properly displayed, or otherwise communicated to a user (e.g., printed, graphically or visually provided, etc.).

For example, in one or more embodiments, the proper spectrum display, or other communicated spectrum, can be achieved by data processing software employing the following or similar steps:

1. Read the stored spectral values from the data-file;
2. Read the corresponding stored energy values from the data-file;

3. Read the stored bias voltage value from the data-file;

4. Produce the offset energy values by adding the bias voltage, $V_B$ to the energy values;

5. Optionally, display the spectral values and the offset energy values on a display, such as an (x,y) graph.

In one or more embodiments, the analysis method includes applying a positive electrical bias to the sample analyzed, thereby, creating a retarding electric field between the sample surface and the energy analyzer input optics and, therefore, reducing the kinetic energy, E, of the Auger electrons for all spectral peaks. The improvement is gained by shifting the naturally occurring spectrum to lower energy where the ΔE of the analyzer is smaller. The analyzer need not be modified in any way and may operate always at its native energy resolution, c. As such, an existing instrument may be upgraded by addition of a sample holder apparatus such as described herein.

In addition, a further benefit regarding sensitivity of the analyzer to sample topography is realized by biasing the sample. It is generally known that the positions of the Auger spectral peaks measured by a CMA are sensitive to the distance of the analyzed sample surface from the CMA input (i.e., the sample height or "working distance") and that the sample surface must be accurately positioned at this working distance to obtain an accurate energy scale; hence accurate chemical information, in the measured Auger spectrum. The working distance is characteristic of the analyzer and is established by the design and tuning, or operating configuration, of the analyzer. The equation $\Delta E = k \cdot \Delta z \cdot E$ expresses the shift, ΔE, in the observed peak position (i.e., the peak energy), E, from the expected position in the Auger energy spectrum, as a function of Δz, the deviation in distance of the sample surface from the optimum working distance and of the kinetic energy, E, of the Auger electrons. "k" is a constant that is intrinsic to the analyzer. This shows that a sample surface, or a particular portion of a sample surface, that is not at the optimal working distance will result in there being a variance, ΔE, in the Auger peak position, hence, an error in the observed Auger peak energy. However, since the effect of sample biasing is to reduce the natural kinetic energy, $E_0$, of the Auger electrons for a given Auger spectral peak by some factor, f, then it can be seen from the expression above that the sensitivity of the Auger peak positions to deviations from the optimal working distance is reduced since, if the final, biased kinetic energy of the electrons as they pass through the analyzer is reduced to some fraction of $E_0$, $E_f = E_0 \cdot f$, where f is less than 1.0, then $\Delta E_f = k \cdot \Delta z \cdot E_f$ where, $\Delta E_f = \Delta E \cdot f$, the reduced shift in the peak position due to sample surface variance from optimal, or sample topographic differences.

One or more embodiments of the apparatus, systems or methods provided herein may provide one or more of the following potential benefits:

- Increase the capability of Auger spectrometers, that use a cylindrical mirror analyzer (CMA), to obtain chemically-specific information about solid surfaces or to separate overlapping spectral features. An example of an existing product is the PHI 700 Scanning Auger Nanoprobe. However, the present disclosure may apply to all annular-acceptance electron energy analyzer types in the field of solid surface analysis.
- There does not need to be any modification to the analyzer or other critical optical components of the spectrometer or incident particle sources to achieve improvement in the energy resolution by this method. Other approaches to the problem include adding retarding fields inside the analyzer and this has deleterious effects, including reduction of the analyzer transmission.
- Energy resolution is continuously adjustable over the usable range.
- Secondary electron (SE) image is now from backscattered electrons which provide a different contrast in the image and can give grain structure information; may be able to measure grain orientation after a calibration step.
- Shifting Auger peak into 10-20 eV range may allow real-time elemental image with imaging secondary electron detector.
- FAT (fixed analyzer transmission) mode for CMA by scanning the sample potential instead of the analyzer; analyzer pass energy held constant at low kinetic energy.
- Better energy resolution (and signal rates) than available from retarding grids.
- No modification of analyzer, electron source or gun optics, or ultra high vacuum (UHV) chamber.
- Upgrades of existing equipment can be done on-site—return to factory is not required.
- Direct measurement: not a software deconvolution technique (although the method may enable a software deconvolution technique by allowing a direct determination of the analyzer broadening function).
- Measurement of electrically insulating samples may be enhanced by the biasing method since the Ar ion flux used for charge neutralization of these samples would have to be at higher incident energy, therefore, more ion current would be available for neutralization; low ion current is a problem with the ion neutralization at lower incident energies used at 0 V bias. The effect of the bias, when the sample is coated with a conductive layer, like normal airborne carbonaceous contamination, may be to drain static charge from the sample surface, thereby, aiding in "charge neutralization".
- Sample access by auxiliary beams is maintained, for example, the ion gun can still sputter-clean the sample or provide low energy ions for sample neutralization.
- Full sample movement is maintained, including tilt, rotate and x and y position adjustment.
- The sensitivity of the Auger peak positions to sample height is reduced, as compared with the native energy resolution peak positions, by the application of the bias voltage.
- The method extends the region of the Auger spectrum that is accessible to analysis by an existing Auger instrument. Typical commercial instruments restrict—by design, to reduce cost and complexity while maintaining a practical analytical capability—the measurable range of Auger electrons to about 0-3200 eV; however, there are many Auger transitions (peaks) that are at higher kinetic energies than 3200 eV and are, therefore, not detectable by current commercial Auger instrument offerings. For example, the higher energy transitions of the element Pt were measured by a special apparatus in the range 5000-12000 eV (see L. H. Toburen and R. G. Albridge, Nuclear Physics A, 90(3) 529 (1967); such energies being well outside of the capabilities of current typical commercial instruments. Since these higher energy Auger electrons, that fall outside the designed energy range of the analyzer, can be reduced in energy by the apparatus and methods described herein and, therefore, brought into the range of the analyzer, the analytical usefulness of, for example, the typical commercial analyzer instrument is increased. This additional analytical energy range (i.e., kinetic energies higher than 3200 eV) enabled by the sample holder apparatus as described herein, allows the sample to be interrogated to greater depths below the sample surface since the escape of Auger electrons through the surface region, from greater depths is a strong, direct function of their initial kinetic energy.

A description of one or more apparatus that may be modified with the sample holder apparatus described herein is provided in, for example, Japan Pat. Appl. No. JP2006-302689A, entitled "Auger Electron Spectral Analysis Device and Auger Electron Spectral Analysis Method," and U.S. Pat. No. 5,032,724, entitled "Multichannel Charged-Particle Analyzer," issued 16 Jul. 1991; all of which are incorporated herein in their entirety by reference thereto. However, the present disclosure is not limited to application of the sample holder apparatus to only such apparatus as described in such documents as will be appreciated by one skilled in the art but is applicable to any annular-acceptance systems and/or analyzers.

For example, FIG. 1 is an illustrative simplified longitudinal section of analyzer system 10 including a cylindrical mirror analyzer (CMA) 30 (a type of annular-acceptance analyzer) and incorporating a sample holder apparatus 100. For example, the system 10 is an analyzer system as described in U.S. Pat. No. 5,032,724 modified using a sample holder apparatus 100.

As described in U.S. Pat. No. 5,032,724, the electron energy analyzing system 10 generally includes the components of conventional analyzing systems such as the components in a Model 25-120A Auger electron spectroscopy analyzer available from The Perkin-Elmer Corporation, the CMA Models 25-130, 25-140 and 25-150 available from Physical Electronic, Inc. (MN), the Model CMA 100 available from Omicron NanoTechnology, the Models ESA 100, ESA 150, DESA 100 and DESA 150 available from Staib Instruments, the Model CMA-D 40B1 available from C4 Scientific Instruments, and the Model CMA 2000 available from LK Technologies, except as modified by the sample holder apparatus generally shown by reference numeral 100. This FIG. 1 is a simplified schematic diagram and various details may be found in references such as the aforementioned U.S. Pat. No. 4,205,226.

The analyzing system 10 is enclosed in a multi-component housing 14 which is maintained at vacuum by an ion pump (e.g., conventional components not being shown). For clarity other standard parts such as viewing ports, internal valving, and the like are also not shown. An electron gun 18 located on the axis 16 of the system may be any desired type such as may be based on electrostatic or magnetic optics, or thermionic or field emission of electrons. A target of sample material to be surface analyzed is placed at an outer end 22 of the system using the sample holder apparatus 100.

The system is generally cylindrical, and all of the components located between the electron gun and the target have an axial passage 24 extending therethrough so that a primary electron or other energy beam 25 can be directed from the gun 18 onto the target (e.g., directed from the gun 18 through an aperture of the sample holder apparatus 100 onto a surface of the target sample, directed from the gun 18 onto a surface of a target sample protruding through an aperture of the sample holder apparatus 100, etc.). Electron optical components for the beam, shown generally at 26 may also be disposed coaxially as required, such as a variable aperture objective, steering plates, an objective lens, a deflector and a stigmator, some of which may be magnetic.

The beam from the gun causes charged particles 27 to be emitted from the target. The particles may be positive ions, negative ions or electrons, for example Auger electrons. In other cases the axial beam 25 to the target may be an ion stream, X-rays or any other suitable energy source, and the emission may include reflected electrons.

The system 10 may have two energy analyzers operating in tandem with respect to emitted elections 27. The first, or primary analyzer may be a conventional cylindrical mirror analyzer 30 (CMA). This analyzer 30 may include an outer conductive cylinder 32 (e.g., a cylindrical electrode) and an inner conductive cylinder 34 (e.g., a cylindrical electrode). The outer cylinder may have a negative voltage applied thereto relative to a reference voltage on the inner cylinder; the reference generally being ground potential. Voltages are provided by a DC source 36 via leads 38 in a through-fitting 40 in the housing 14.

Electrons 27 diverging from the target within a certain range of conical angles 29 (the angle of the diverging electrons being relative to a plane at the sample surface orthogonal to axis 16) pass through a first annular gap 42 and a grounded screen 43 and enter the space 44 between the cylinders. Because of the field associated with the negative voltage on the outer cylinder 32, the electrons will follow a path 28 that curves back toward the axis 16 of the system. The exact path or trajectory for each electron is dependent on the kinetic energy of the electron relative to the field. Those electrons having an energy within a small range of energies will exit the space 44 through another grounded screen 45 and an annular passage 47 in the inner cylinder 34, to be detected by a detection system 50 located within the inner cylinder 34 opposite the end 22.

In one or more embodiments of analyzer systems, such as disclosed in the aforementioned U.S. Pat. No. 4,205,226, a small annular opening is provided for the electron detector. By changing the voltage on the outer cylinder the energy band selected by the detector is changed correspondingly. Thus scanning of the voltage combined with electron detection of electrons transmitting the gap provides a spectrum which may be correlated with characteristics of the target, such as material and topography. Processor 71 is suitably connected to the components of the system for control thereof, such as by leads 69, and, for example, to receive signals for conversion to spectrographic information of energy distribution (e.g., for use in creating a display of information or other presentation of information, for running routines for correction of data as described herein, for control of the application of bias potential to the sample support member and measurement thereof, etc.).

In one or more embodiments, the sample holder apparatus 100 includes a grounded sample aperture member and an electrically isolated sample support member to which is applied a retarding bias potential (e.g., together shown as reference numeral 110). The sample support member includes a sample receiving surface upon which a sample (e.g., a sample to be analyzed) may be mounted such that the sample is electrically coupled or connected to the sample support member (e.g., the sample being held at the same potential as the sample support member). The bias potential is applied to the sample support member, and thus the sample, by a source 112 (e.g., via leads 113 in a through-fitting in the housing 14, or in any other manner).

Generally, the grounded sample aperture member is electrically isolated from the sample support member (e.g., such as with use of electrical insulative spacers). As used herein, the term "grounded" when used in conjunction with a sample aperture member (e.g., aperture plate, etc.) refers to the sample aperture member generally being held at ground potential of the analyzer (i.e., at the reference voltage of the analyzer, which for a CMA is generally the voltage on the inner conductive cylinder of the analyzer, such as inner conductive cylinder 34 as shown in FIG. 1). In other words, a grounded sample aperture member refers to a sample aperture member that is grounded and has no potential applied thereto, or a sample aperture member that may have a small voltage (positive or negative) applied thereto. Such a small voltage applied thereto is generally a voltage that would not result in significant alterations to the planar-spherical field and resulting trajectories. Further, generally, such a small voltage is less than about 10 percent of the voltage applied to the sample support member. A voltage applied to the sample aperture member that is higher than about 10 percent of the voltage applied to the sample support member would result in significant alterations to the planar-spherical field and resulting trajectories, such that, for example, electrons would not enter the CMA with the proper range of input elevation angles.

In one embodiment, the grounded sample aperture member surrounds a substantial portion of the sample support member (or otherwise includes one or more surfaces located between the sample support member and the analyzer components that receive the emitted electrons) and includes an aperture (e.g., a circular aperture having an axis therethrough, an aperture orthogonal to an axis at its center, etc.) in proximity to the sample (e.g., above the sample, flush with the sample, the sample extending through the aperture with a surface above the aperture, etc.). In other words, at least in one embodiment, the aperture (e.g., an aperture generally parallel to the sample receiving surface, at least in one embodiment) provides access to the surface of the sample to be analyzed and reduces the biased area directly under the analyzer such that an electrical retarding field (e.g., an axially symmetric electrical retarding field) is created in a reduced area about the aperture and over the sample surface to be analyzed. The aperture may be circular in order to create an axially symmetric retarding field. In one embodiment, the grounded sample aperture member surrounds the sample support member to shield all the retarding field except that portion in proximity to the circular aperture.

The sample holder apparatus 100 may be configured to provide full sample movement, including, for example, tilt, rotation, and x, y, and z adjustment. For example, such sample movement may be provided using any known stage movement apparatus such as with the use of leadscrew or rack and pinion actuation, manually driven linear or rotary feedthroughs, electric motors internal or external to the vacuum, or piezoelectric motors. For example, similar movement of a conventional stage apparatus is provided in the PHI Model 15-680, available from Physical Electronics, Inc. (MN).

Further, in one or more embodiments, the sample support member or the sample support member and the sample aperture member (together 110) may be mounted on an instrument stage, such as stage 115 generally shown in FIG. 1. As such, stage movement apparatus as described above may be used to provide full sample movement of the components. Further, for example, the sample support member may be mounted separately and independently (e.g., on an instrument stage) from the sample aperture member (e.g., the sample aperture member may be mounted separately to allow movement of the sample aperture member relative to the sample receiving surface of the sample support member, such as being movable into a retracted position using one or more components like those used for accomplishing sample stage movement). Still further, the sample support member may be mounted (e.g., as part of the instrument stage of an analyzer) such that it is movable apart from the independently mounted sample aperture member.

Figure 2A:
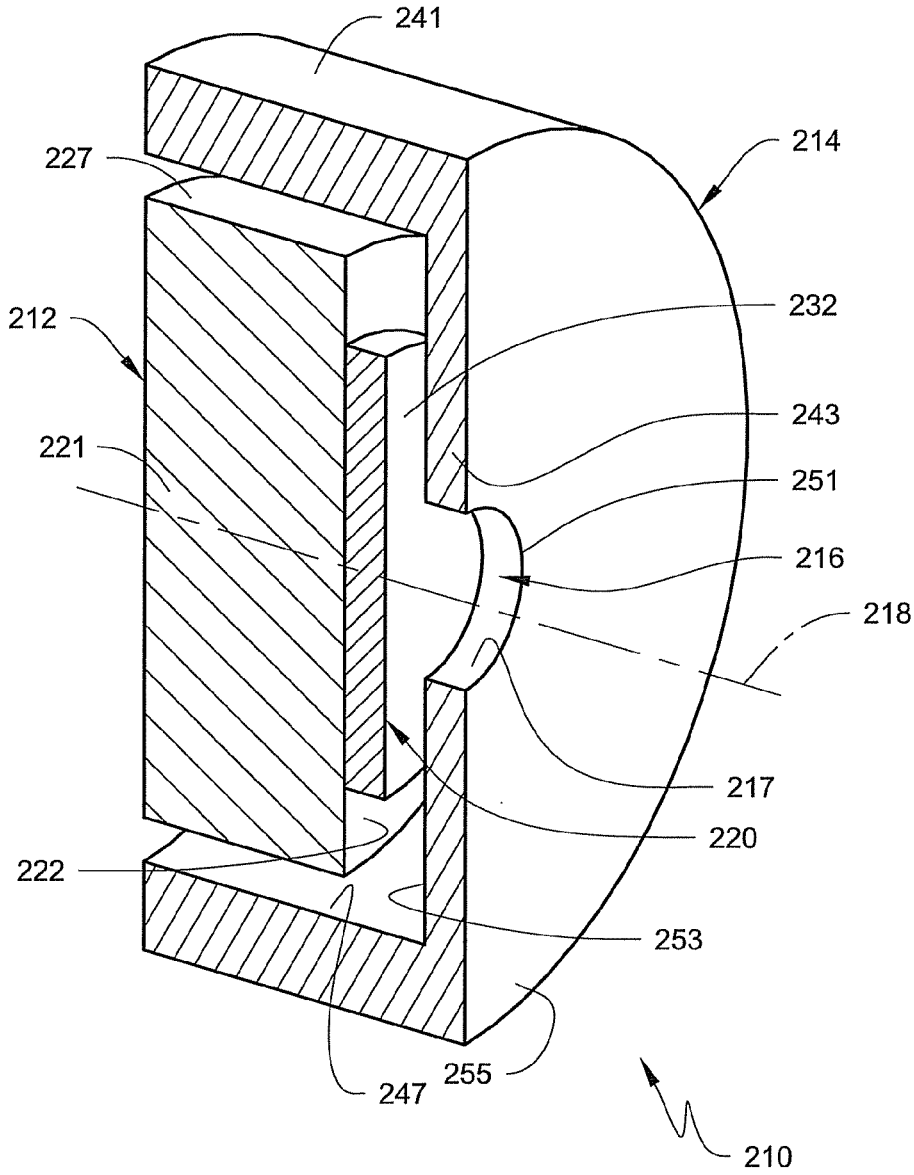
FIG. 2A is a schematic, isometric cutaway view of one generalized embodiment of a sample holder apparatus that may be used to reduce energy of electrons in an annular-acceptance analyzer.

FIG. 2A shows a schematic, isometric cutaway view of a portion of one generalized embodiment of a sample holder apparatus 210 that may be used to reduce energy of electrons in an annular-acceptance analyzer system, such as the analyzer system 10 shown in FIG. 1. The exemplary sample holder apparatus 210 includes a grounded sample aperture member 214 and an electrically isolated sample support member 212 to which is applied a retarding bias potential (e.g., source not shown). The sample support member 212 includes a sample receiving surface 222 (e.g., a planar surface) terminating a cylindrical body member 221 lying along axis 218 of the sample holder apparatus 210 and upon which a sample 220 (e.g., a sample to be analyzed) may be mounted such that the sample 220 is electrically coupled or connected to the sample support member 212 (e.g., the sample 220 being held at the same potential as the sample support member 212). The cylindrical body member 221 including a cylindrical outer surface 227 at a distance from axis 218. For example, the axis 218 may coincide with the axis 16 of an analyzer system, such as system 10 shown in FIG. 1.

The grounded sample aperture member 214 is electrically isolated from the sample support member 212 (e.g., such as with use of electrical insulative spacers, not shown, or in any other suitable insulative manner). In one embodiment, as shown in FIG. 2A, the grounded sample aperture member 214 includes a cylindrical wall 241 including an inner surface 247 located at a distance from the axis 218 and surrounding the cylindrical body member 221 of sample support member 212 (e.g., the sample aperture member 214 may be physically fixed to the sample support member 212 such that they do not move independently of each other). Further, the grounded sample aperture member 214 includes an end portion 243 (e.g., a generally planar end having a inner surface 253 adjacent but isolated from the sample receiving surface 222 and an outer surface 255 facing the analyzer components of an analyzer system, such as system 10 in FIG. 1) terminating the cylindrical wall 241. In other words, the grounded sample aperture member 214 includes one or more surfaces or material portions located between the sample support member 212 and the analyzer components that receive the emitted electrons, such as the gap between the electrodes of analyzer 30 as shown in FIG. 1.

The grounded sample aperture member 214 of FIG. 2A further includes a circular aperture 216 (e.g., having a thickness defined by the thickness or distance between the outer surface 255 and inner surface 253) defined in the end portion 243 by one or more surfaces 217 (e.g., along axis 218, or in other words, the aperture 216 is orthogonal to the axis 218 at its center) in proximity to the sample 220 when positioned for analysis (e.g., above the sample 220 as shown in FIG. 2A, but may be flush with the sample 220, the sample 220 may extend through the aperture 216 with a surface 232 above the aperture 216, etc.). In at least in one embodiment, a circular aperture 216 (e.g., an aperture generally parallel to the surface of the sample receiving surface 222, at least in one embodiment) provides access to the sample surface 232 to be analyzed (e.g., reducing the biased area directly under an analyzer 30 such as shown in FIG. 1 with which the sample holder apparatus 210 can be used such that an axially symmetric electrical retarding field is created in a reduced area about the aperture and over the sample surface 232 to be analyzed). The aperture 216 in the embodiment of FIG. 2A is circular to create an axially symmetric retarding field. The grounded sample aperture member 214 surrounds the sample support member 212 to shield all the retarding field except that portion in proximity to the circular aperture 216.

The combination of grounded sample aperture member 214 along with the bias potential applied to the sample support member 212 and electrically connected sample 220 produces an electrical retarding field that reduces the energy of the electrons before they enter the analyzer (e.g., an electrical retarding field over the aperture 216, and thus, the sample surface 232 being analyzed). For example, in one or more embodiments, the electrical retarding field is created at least about the aperture 216 (e.g., a plurality of equipotential surfaces can be calculated that extend at least from edges 251 defining the aperture 216 and outward from the sample 220 towards the analyzer, such as analyzer 30 as shown in FIG. 1 with which the sample holder apparatus 210 may be used).

Further, at least in one embodiment, the electrical retarding field is confined to the region in proximity to the aperture 216 by the grounded sample aperture member 214 (e.g., confined by the one or more grounded surfaces such as the grounded cylindrical wall 241 and grounded end portion 243 that includes the aperture 216 formed therein). At least in one or more embodiments, due to the shape of the field, which is substantially planar near the sample surface and non-planar (e.g., substantially spherical farther from the sample surface, or, for example, more non-planar the further the distance from the sample surface), the trajectories of the electrons are bent outward from the optical axis such that they fill the entrance to an analyzer and enter with the desired range of input angles (e.g., the electrons diverging from the target sample within a certain range of conical angles pass through a first annular gap 42 and a grounded screen 43 and enter the space 44 between the cylindrical electrodes 32 and 34 shown in FIG. 1).

Figure 2B:
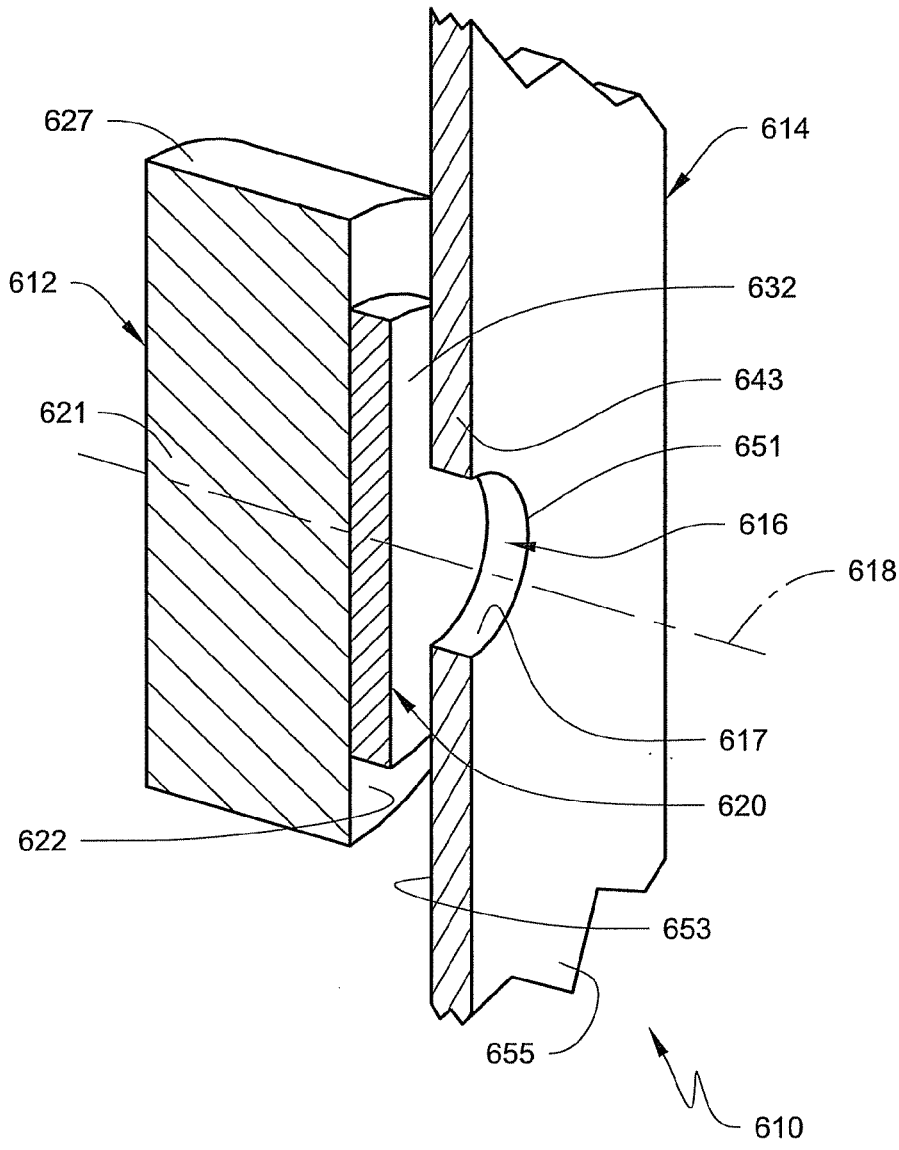
FIG. 2B is a schematic, isometric cutaway view of an alternate generalized embodiment of a sample holder apparatus that may be used to reduce energy of electrons in an annular-acceptance analyzer.

FIG. 2B shows a schematic, isometric cutaway view of a portion of one alternate generalized embodiment of a sample holder apparatus 610 that may be used to reduce energy of electrons in an annular-acceptance analyzer system, such as the analyzer system 10 shown in FIG. 1. The exemplary sample holder apparatus 610 is similar to the sample holder 210 shown in FIG. 2A except that the exemplary sample holder apparatus 610 includes a grounded sample aperture plate 614 that is mounted separately from electrically isolated sample support member 612 to which is applied a retarding bias potential (e.g., source not shown). With such separate mounting of the components, the aperture defined by the grounded sample aperture plate 614 and the sample receiving surface 622 can be moved relative to the other (e.g., the sample receiving surface 622 can be moved under the aperture 616).

The sample support member 612 (e.g., which may be mounted on an instrument stage or provided as part of an instrument stage) includes a sample receiving surface 622 (e.g., a planar surface) terminating a cylindrical body member 621 lying along axis 618 of the sample holder apparatus 610 and upon which a sample 620 (e.g., a sample to be analyzed) may be mounted such that the sample 620 is electrically coupled or connected to the sample support member 612 (e.g., the sample 620 being held at the same potential as the sample support member 612). The cylindrical body member 621 includes a cylindrical outer surface 627 at a distance from axis 618. For example, the axis 618 may coincide with the axis 16 of an analyzer system, such as system 10 shown in FIG. 1.

The grounded sample aperture plate 614 is electrically isolated from the sample support member 612 and movement is possible between the receiving surface 622 of the sample support member 612 and the grounded sample aperture plate 614 (e.g., the sample support member 612 may be moved relative to a fixed aperture, the aperture may be retracted from a position between the sample receiving surface 622 and the analyzer components, etc.). For example, in one embodiment, the grounded sample aperture plate 614 (e.g., a generally planar structure having an inner surface 653 adjacent but isolated from the sample receiving surface 622 and an outer surface 655 facing the analyzer components of an analyzer system, such as system 10 in FIG. 1) may be coupled to structure (e.g., components like those used to provide full instrument stage movement) configured to allow the aperture plate 614 to be moved relative to the receiving surface 622 (and thus movement of the aperture 616 relative to the sample 620 when mounted thereon).

The grounded sample aperture member 614 of FIG. 2B further includes a circular aperture 616 (e.g., having a thickness defined by the thickness or distance between the outer surface 655 and inner surface 653) defined by one or more surfaces 617 (e.g., along axis 618, or in other words, the aperture 616 is orthogonal to the axis 618 at its center in proximity to the sample 620 when positioned for analysis (e.g., above the sample 620 as shown in FIG. 2B, but may be flush with the sample 620, the sample 620 may extend through the aperture 616 with a surface 632 above the aperture 616, etc.). In at least one embodiment, a circular aperture 616 (e.g., an aperture generally parallel to the surface of the sample receiving surface 622) provides access to the sample surface 632 to be analyzed (e.g., reducing the biased area directly under an analyzer 30 such as shown in FIG. 1 with which the sample holder apparatus 610 can be used such that an axially symmetric electrical retarding field is created in a reduced area about the aperture and over the sample surface 632 to be analyzed).

Still further, in one embodiment, with the grounded sample aperture plate 614 being mounted separately from the sample support member 612 (e.g., not physically attached to one another), the sample support member 612 having the sample mounted thereon may be moved under the aperture 616, thereby, allowing the analyst to select and examine different areas on the sample 620 without having to extract and remount the sample 620 (e.g., allowing analysis of a region of the sample that is larger than the aperture without removing the sample). In other words, full sample movement may be possible under the aperture 616. Further, such separate mounting may allow the aperture plate 614 to be removed or retracted from the region of the sample 620 to allow for other sample analysis/processing that may have been restricted by the presence of the aperture plate 614. In other words, the sample aperture plate 614 is not physically fixed to the sample support member 612 and they are allowed to move independently of each other.

Figure 2C:
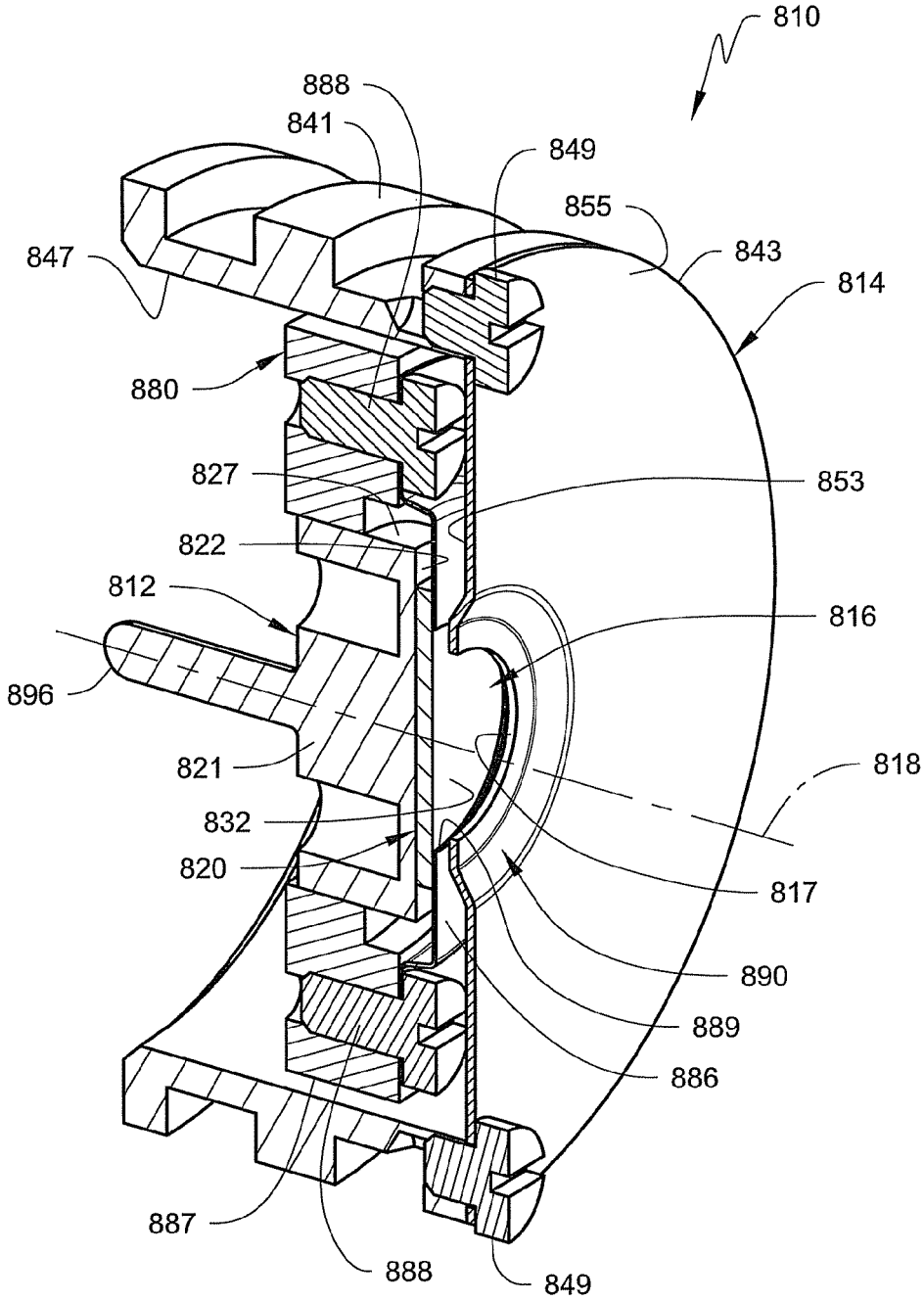
FIG. 2C is a schematic, isometric cutaway view of yet another alternate generalized embodiment of a sample holder apparatus that may be used to reduce energy of electrons in an annular-acceptance analyzer.

FIG. 2C shows a schematic, isometric cutaway view of a portion of another alternate generalized embodiment of a sample holder apparatus 810 that may be used to reduce energy of electrons in an annular-acceptance analyzer system, such as the analyzer system 10 shown in FIG. 1. The exemplary sample holder apparatus 810 is similar to the sample holder 210 shown in FIG. 2A except that the exemplary sample holder apparatus 810 further includes a positioning plate structure 880 and a grounded sample aperture member 814 that includes a recessed aperture region 890.

For example, FIG. 2C shows a sample holder apparatus 810 that includes a grounded sample aperture member 814 and an electrically isolated sample support member 812 to which is applied a retarding bias potential (e.g., source not shown). The sample support member 812 includes a sample receiving surface 822 (e.g., a planar surface) terminating a cylindrical body member 821 lying along axis 818 of the sample holder apparatus 810 and upon which a sample 820 (e.g., a sample to be analyzed) may be mounted such that the sample 820 is electrically coupled or connected to the sample support member 812 (e.g., the sample 820 being held at the same potential as the sample support member 812). Opposite the sample receiving surface 822, an elongated mating element 896 is provided for engagement with another mating element (not shown) to place the receiving surface 822 in a particular position in the analyzer (e.g., the elongated mating element 896 may mate with an instrument stage mating element). The sample support member 812 further includes a positioning plate structure 880.

The positioning plate structure 880 includes a cylindrical element 887 at least partially about the cylindrical outer surface 827 of the cylindrical body member 821 (e.g., in contact with the cylindrical body member 821 at a distance from axis 818). The positioning plate structure 880 further includes a retaining plate 886 located between the grounded sample aperture member 814 and the cylindrical body member 821 of the electrically isolated sample support member 812. The retaining plate 886 includes an aperture 889 aligned with aperture 816 of the grounded sample aperture member 814 to allow access to the sample 820. Further, the retaining plate 886 is coupled to the cylindrical element 887 of the positioning plate structure 880 by one or more fasteners 888. The retaining plate 886 of the positioning plate structure 880 may be used to hold the sample 820 in place. The exemplary retaining plate 886 may include a raised center and the opening 889 defined therein for exposing the sample to the analysis instrument in the area of aperture 816 provided in the grounded sample aperture member 814.

Although one exemplary positioning structure (e.g., positioning plate structure 880) is shown in FIG. 2C, it will be recognized that any number of techniques may be used to hold the sample 820 in place for analysis. For example, samples may be held down via their front side as shown in FIG. 2C, or alternatively, via their back side, or side edges. For example, fasteners including threaded screws, pins, retaining rings, hold-down plates, spring clips or clamps may be used to hold down the samples. Further, for example, and clearly not limited thereto, such samples may be held down using conductive adhesives such as glues, epoxies, or silver paint, and/or conductive sticky tapes (e.g., double sided conductive tape). Still further, for example, the sample may be set in a recessed hole and held down by gravity.

The grounded sample aperture member 814 is electrically isolated from the sample support member 812 (e.g., such as with use of electrical insulative spacers, not shown, or in any other suitable insulative manner). In one embodiment, as shown in FIG. 2C, the grounded sample aperture member 814 includes a cylindrical wall member 841 including an inner surface 847 located at a distance from the axis 818 and surrounding the cylindrical element 887 of sample support member 812 (e.g., the sample aperture member 814 may be physically fixed to the sample support member 812 such that they do not move independently of each other). Further, the grounded sample aperture member 814 includes an end aperture plate 843 (e.g., a generally planar end having an inner surface 853 adjacent but isolated from the sample receiving surface 822 and an outer surface 855 facing the analyzer components of an analyzer system, such as system 10 in FIG. 1) terminating and coupled to the cylindrical wall 841 by one or more fasteners 849. In other words, the grounded sample aperture member 814 includes one or more surfaces or material portions located between the sample support member 812 and the analyzer components that receive the emitted electrons, such as the gap between the electrodes of analyzer 30 as shown in FIG. 1.

The grounded end aperture plate 843 of FIG. 2C further includes a circular aperture 816 (e.g., having a thickness defined by the thickness or distance between the outer surface 855 and inner surface 853) defined in the end aperture plate 843 by one or more surfaces 817 (e.g., along axis 818, or in other words, the aperture 816 is orthogonal to the axis 818 at its center) in proximity to the sample 820 when in one position for analysis (e.g., above the sample 820 as shown in FIG. 2C). In at least one embodiment, a circular aperture 816 (e.g., an aperture generally parallel to the surface of the sample receiving surface 822) provides access to the sample surface 832 to be analyzed (e.g., reducing the biased area directly under an analyzer 30 such as shown in FIG. 1 with which the sample holder apparatus 810 can be used such that an axially symmetric electrical retarding field is created in a reduced area about the aperture and over the sample surface 832 to be analyzed). The aperture 816 in the embodiment of FIG. 2C is circular to create an axially symmetric retarding field and is located in a recessed aperture region 890 of the grounded end aperture plate 843. Such recessed aperture region 890 is configured to allow use of the positioning plate structure 880 and the fasteners 888 thereof.

One will recognize that one or more various configurations of sample holder apparatus (e.g., the size and shape) may be used to provide the retarding field as described herein. The disclosure is not limited to only the generalized sample holder apparatus shown herein, but includes other apparatus that can be provided with use of various combinations of the structural elements shown in the various embodiments herein. However, some configurations may be more beneficial than others.

Various other embodiments of sample holder apparatus are further described herein with reference to FIGS. 3-14. Generally, such apparatus provide an electrical retarding field over the sample surface being analyzed to reduce the energy of the electrons entering the analyzer.

Sample surfaces to be analyzed are typically nearly planar. Applying a retarding potential to such a sample (e.g., without a grounded aperture being used such as described herein) generally creates a retarding field that would be substantially planar (e.g., above the planar sample surface). Use of this planar retarding field would undesirably bend the emitted electron trajectories significantly outward away from the central axis (e.g., axis 16 of the analyzer 30 along which the annular-acceptance region is located or aligned such as shown in FIG. 1) such that the emitted electrons would most likely not fill the entrance of the analyzer and would most likely not enter the analyzer with the proper range of input angles.

In one or more embodiments, as described herein, by adding or using a grounded circular aperture in proximity to the sample surface (e.g., such as where the sample is protruding through and above the aperture, where the sample surface is flush with the aperture, or where the sample surface is below the aperture), a substantially spherical field can be created farther away from the sample surface. In other words, at least in one or more embodiments, the retarding field is then substantially planar close to the sample surface and substantially spherical farther away from the sample surface. For example, this combination planar-spherical field bends the trajectories of the emitted electrons outward away from the central axis but by a much smaller amount than does the substantially planar field when used by itself.

In one or more embodiments, the relative amounts of planar and spherical fields are controlled. For example, the relative amounts of planar and spherical fields may be controlled by the design of the diameter and thickness of the aperture and its position relative to the sample (e.g., that is, such as the gap distance for the case of a sample located below the aperture, or in other words the gap distance between the surface 232 of sample 220 and an inner surface 253 of the end portion 243 facing the sample 220). With the proper proportion of planar to spherical field, this allows for filling the CMA annular input and adjusting the input angles to the CMA. Advantageously, these input angles can be chosen to be the conventional range of input angles, namely 36 to 48 degrees, so that the CMA input is substantially filled and no modification to the CMA is necessary.

Because the planar-spherical field bends the electrons away from the central axis, it can be readily understood that it is particularly suitable to annular-acceptance analyzers where the beam is received off-axis. However, it could also be employed with an on-axis analyzer such as the common SCA (spherical capacitor analyzer), but the transmission would be reduced.

Figure 3:
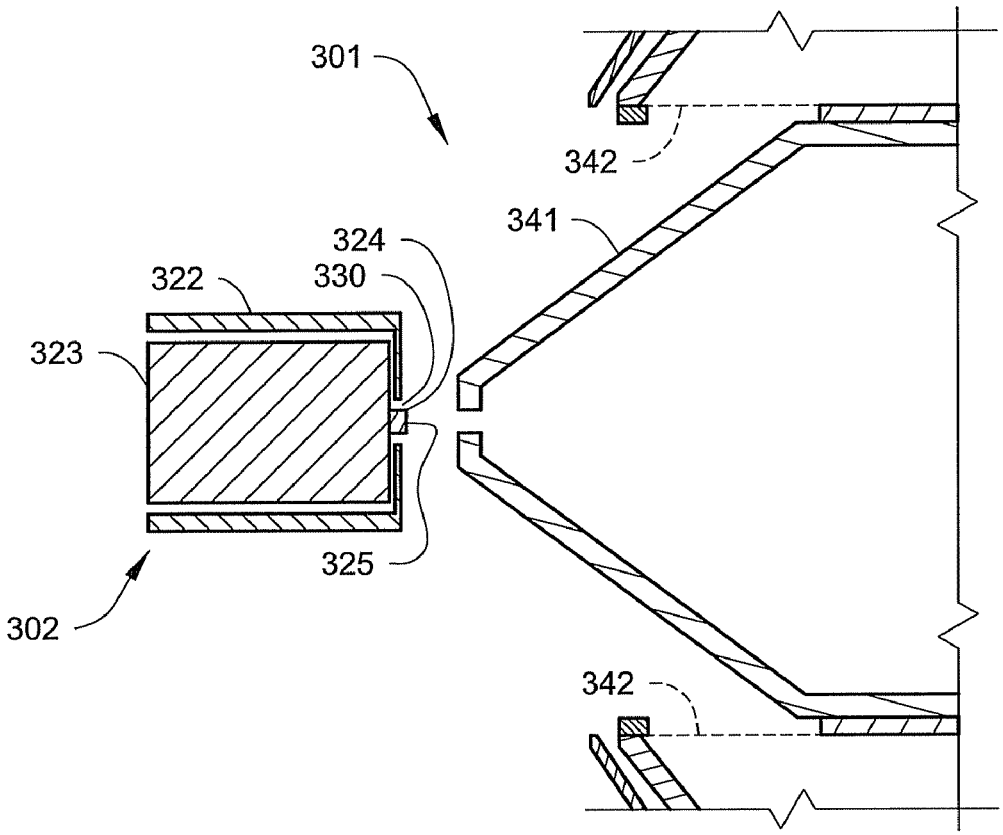
FIG. 3 is a schematic, longitudinal sectional view of a first embodiment of a sample holder apparatus and CMA.

Referring to FIG. 3, the right side of the figure depicts a coaxial CMA and electron gun 301, such as illustrated in FIG. 1. The left side depicts a sample holder apparatus 302 including a sample aperture member 322, sample support member 323, and sample 324. The sample aperture member 322 is electrically grounded. The sample support member 323 is electrically isolated from the sample aperture member 322 and is electrically connected to a positive bias potential (not shown). The sample 324 is mounted directly to the sample support member 323 (e.g., or a post of support member 323), and the two elements 323 and 324 are in electrical contact. The sample surface 325 (e.g., the surface closest to the CMA and which is to be analyzed) protrudes above an aperture 330 (e.g., a circular aperture) defined in the sample aperture member 322.

Figure 4:
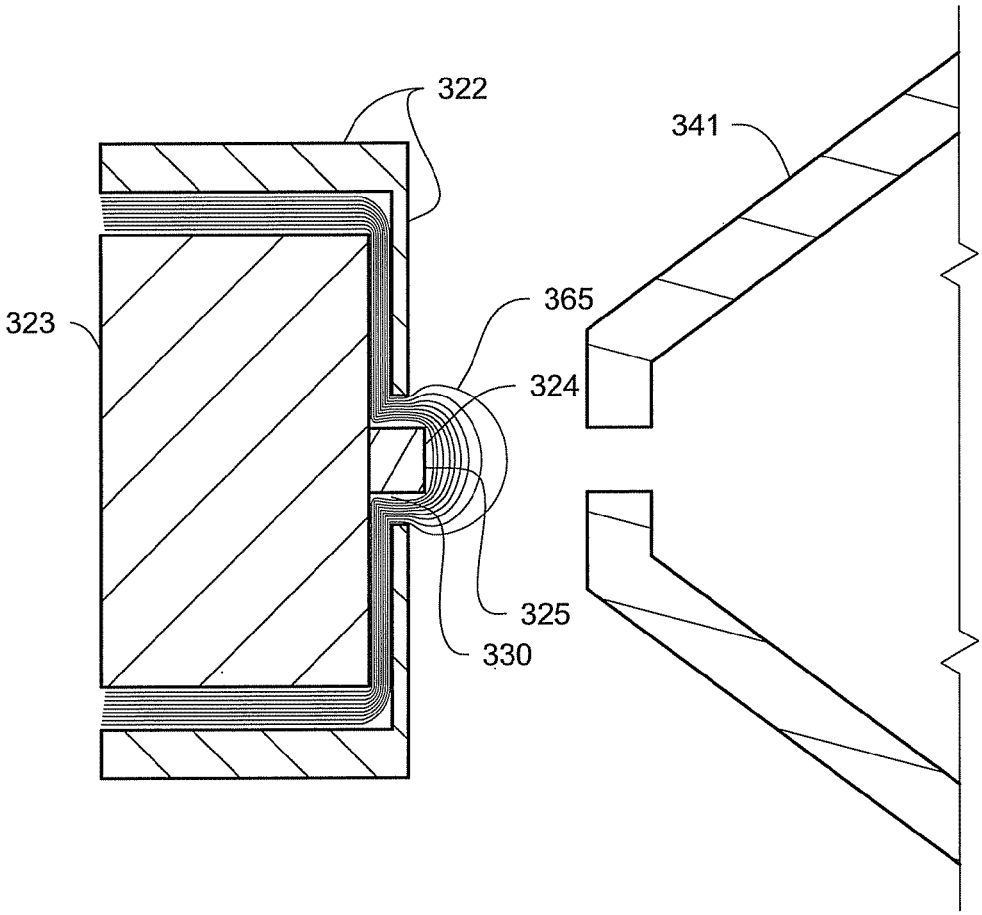
FIG. 4 is an enlarged schematic, longitudinal sectional view of a portion of the first embodiment of a sample holder apparatus and CMA including nine calculated equipotential surfaces.

Referring to FIG. 4, an enlarged view of a portion of FIG. 3 is depicted. Element 341 is a magnetic objective lens pole-piece of the coaxial electron gun and CMA 301. The sample aperture member 322 is electrically grounded. The sample support member 323 has +900 V applied. The sample 324 is mounted to the sample support member 323 and as such also has +900 V applied. A computer program SIMION 3D Version 7.0 was used to calculate nine equipotential surfaces 365 that range from +90 V to +810 V in 90 V increments. The shape of these surfaces changes from nearly planar close to the sample 324 to nearly spherical farther away from the sample 324. For this embodiment, where the sample surface 325 protrudes above the circular aperture 330 in the sample aperture member 322, the sample (and/or post of support member 323) has a small diameter to create enough of a spherical field so that there is the desired proportion of planar to spherical field. Furthermore, for a given sample (and/or post) diameter, the height of the sample above the aperture 330 and the diameter and thickness of the aperture 330 are chosen to produce a planar-spherical field shape that bends the electron trajectories advantageously to fill the annular entrance or gap 342 of the CMA 301 and enter with the conventional range of CMA elevation angles, namely from about 36 to 48 degrees.

Figure 5:
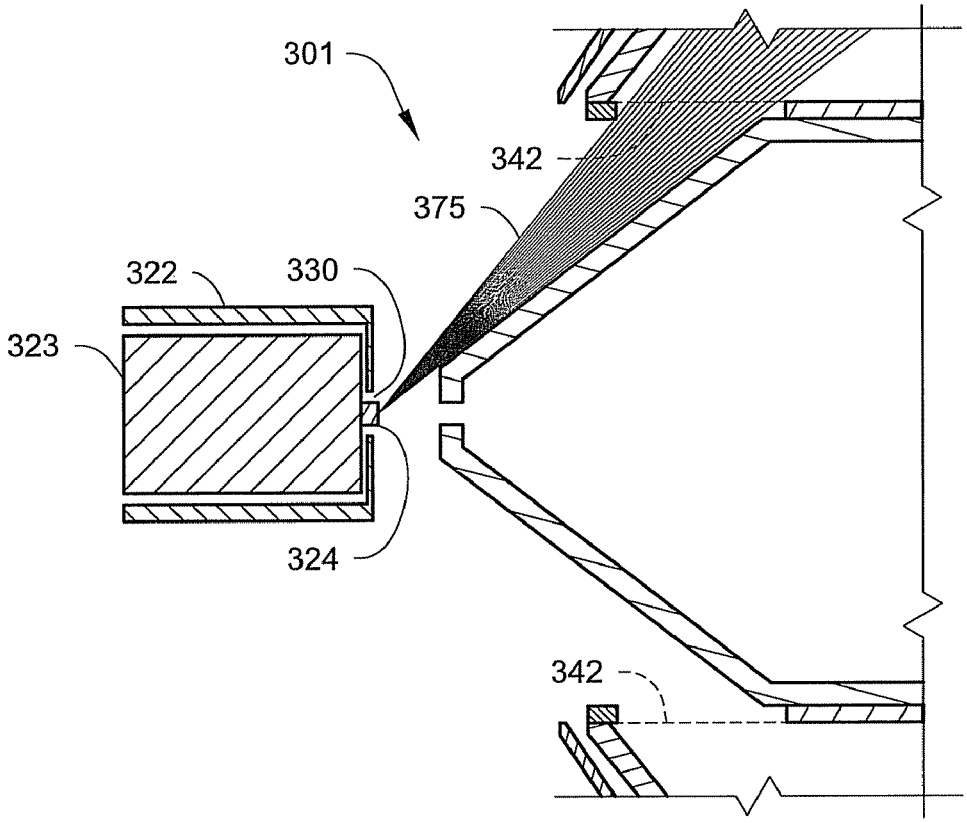
FIG. 5 is a schematic, longitudinal sectional view of the first embodiment of a sample holder apparatus and CMA including twenty-one calculated electron trajectories.

Referring to FIG. 5, operation of the embodiment of FIG. 3 is depicted. The sample aperture member 322 is electrically grounded. The sample support member 323 has +900 V applied. The sample 324 is mounted to the sample support member 323 and as such also has +900 V applied. The computer program SIMION 3D Version 7.0 was used to calculate 21 electron trajectories 375 that originate from the center of the sample 324 (e.g., on axis of the aperture 330). The trajectories 375 were launched with 1000 eV kinetic energy and with 24 to 34 degrees elevation angle. The electrons undergo deflection near the sample 324 as they penetrate the planar-spherical field and are slowed from 1000 eV to 100 eV kinetic energy.

Because of the shape of the planar-spherical equipotential surfaces 365 depicted in FIG. 4, the electrons are deflected advantageously to fill the CMA annular entrance or gap 342 and enter the CMA 301 with the conventional range of CMA elevation angles, namely from about 36 to 48 degrees. Because the electrons undergo a factor of 10 reduction in kinetic energy, the effective CMA resolution is increased by a factor of ten, from a native resolution of about 0.5% to an effective resolution of about 0.05%. No reduction in transmission occurs due to grid transparency or grid scattering. No modification to the analyzer or other critical components of the spectrometer is required (e.g., other than to use the sample holder apparatus described herein).

Figure 6:
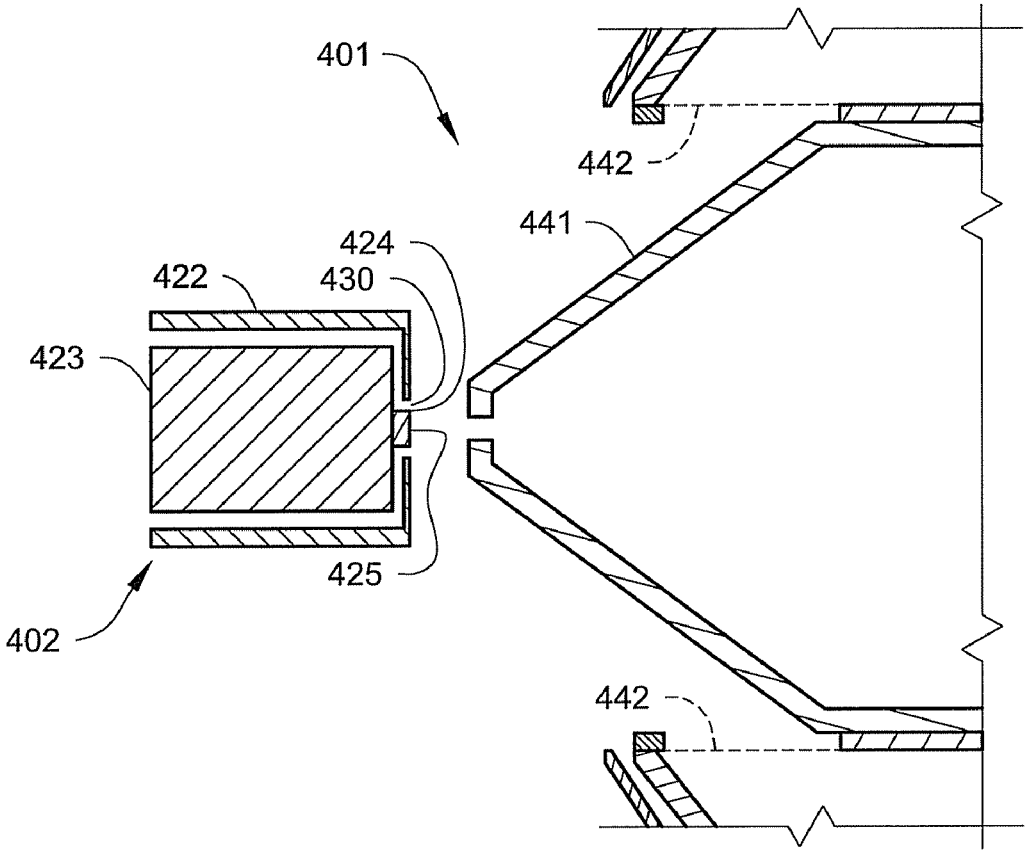
FIG. 6 is a schematic, longitudinal sectional view of a second embodiment of a sample holder apparatus and CMA.

Referring to FIG. 6, the right side of the figure depicts a coaxial CMA and electron gun 401. The left side depicts a sample holder apparatus 402 including a sample aperture member 422, sample support member 423, and sample 424. The sample aperture member 422 is electrically grounded. The sample support member 423 is electrically isolated from the sample aperture member 422 and is electrically connected to a positive bias potential (not shown). The sample 424 is mounted directly to the sample support member 423, and the two elements 423 424 are in electrical contact. The sample surface 425 is flush with the top of the circular aperture 430 in the sample aperture member 422.

Figure 7:
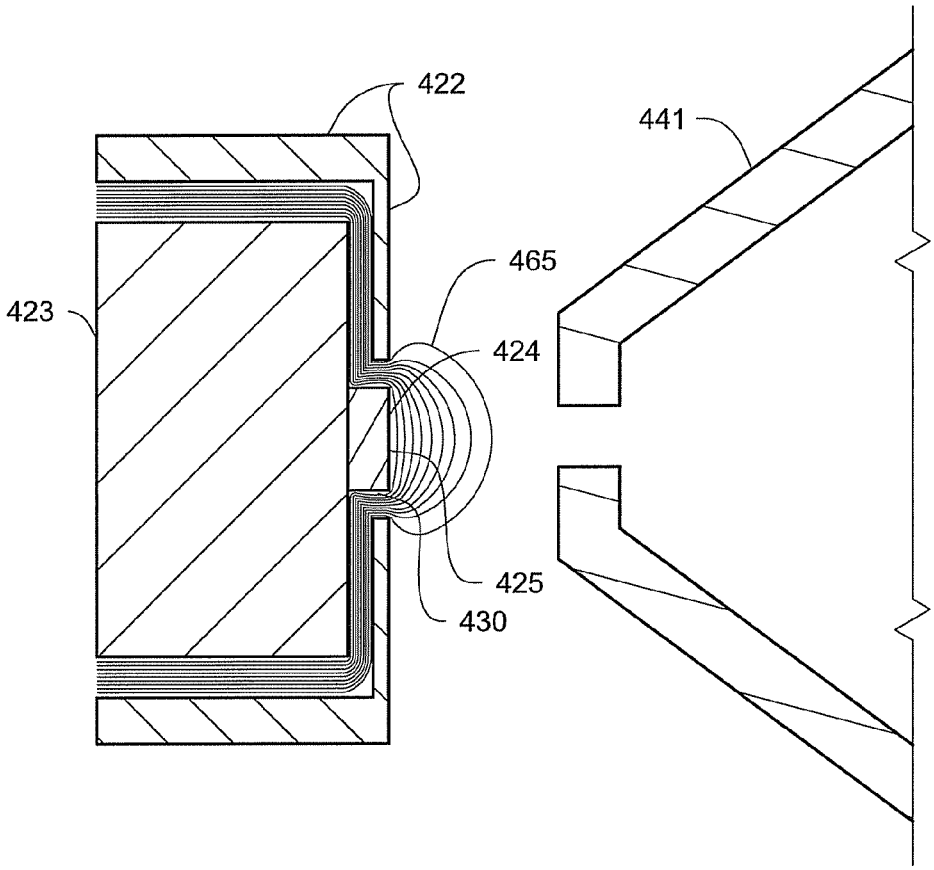
FIG. 7 is an enlarged schematic, longitudinal sectional view of a portion of the second embodiment of a sample holder apparatus and CMA including nine calculated equipotential surfaces.

Referring to FIG. 7, an enlarged view of a portion of FIG. 6 is depicted. Element 441 is the magnetic objective lens pole-piece of the coaxial electron gun and CMA 401. The sample aperture member 422 is electrically grounded. The sample support member 423 has +900 V applied. The sample 424 is mounted to the sample support member 423 and as such also has +900 V applied. The computer program SIMION 3D Version 7.0 was used to calculate nine equipotential surfaces 465 that range from +90 V to +810 V in 90 V increments. The shape of these surfaces changes from nearly planar close to the sample 424 to nearly spherical far away from the sample 424. For this embodiment, where the sample surface 425 is flush with the top of the aperture 430 in the sample aperture member 422, the sample 424 can have a larger diameter than was possible in the embodiment of FIGS. 3-5, and still generate enough of a spherical field so that there is the proper proportion of planar to spherical field. Furthermore, for a given sample diameter, the diameter and thickness of the circular aperture 430 are chosen to produce a planar-spherical field shape that bends the electron trajectories advantageously to fill the annular entrance or gap 442 of the CMA and enter with the conventional range of CMA elevation angles, namely from about 36 to 48 degrees.

Figure 8:
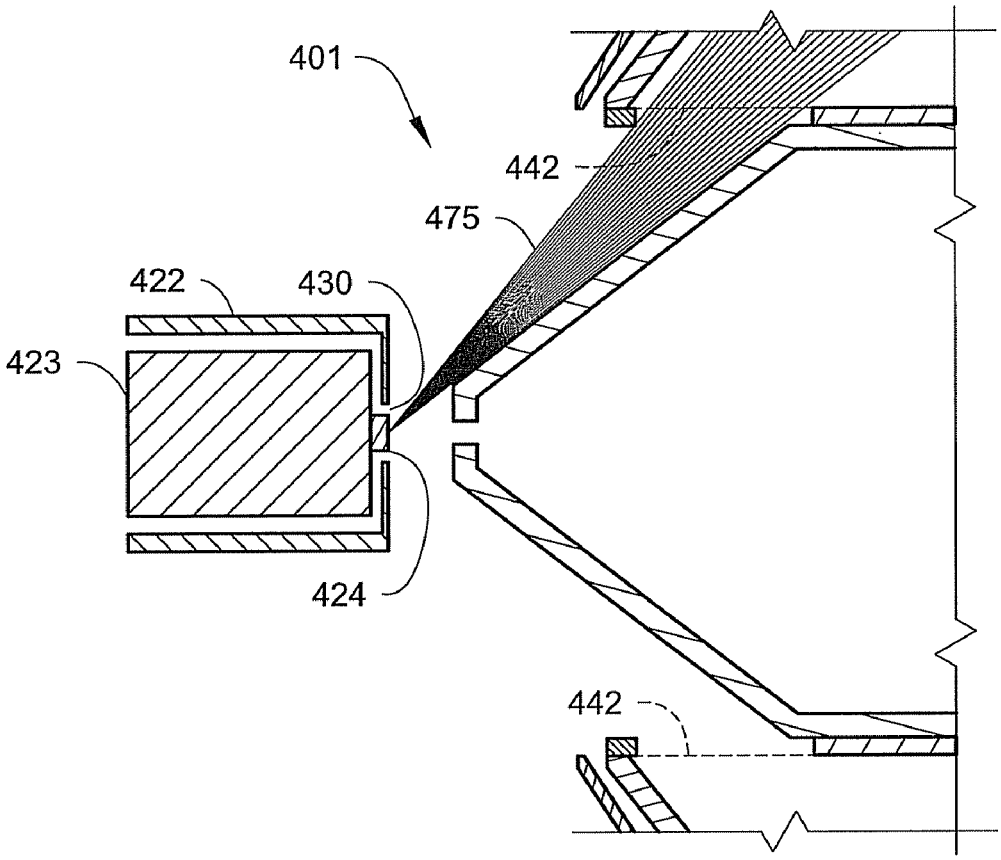
FIG. 8 is a schematic, longitudinal sectional view of the second embodiment of a sample holder apparatus and CMA including twenty-two calculated electron trajectories.

Referring to FIG. 8, operation of the embodiment of FIG. 6 is depicted. The sample aperture member 422 is electrically grounded. The sample support member 423 has +900 V applied. The sample 424 is mounted to the sample support member 423 and as such also has +900 V applied. The computer program SIMION 3D Version 7.0 was used to calculate 22 electron trajectories 475 that originate from the center of the sample 424. The trajectories were launched with 1000 eV kinetic energy and with 23.5 to 34 degrees elevation angle. The electrons undergo deflection near the sample 424 as they penetrate the planar-spherical field and are slowed from 1000 eV to 100 eV kinetic energy.

Because of the shape of the planar-spherical equipotential surfaces 465 depicted in FIG. 7, the electrons are deflected advantageously to enter the CMA 401 with the conventional range of CMA elevation angles, namely from about 36 to 48 degrees. Because the electrons undergo a factor of 10 reduction in kinetic energy, the effective CMA resolution is increased by a factor of ten, from a native resolution of about 0.5% to an effective resolution of about 0.05%. No reduction in transmission occurs due to grid transparency or grid scattering. No modification to the analyzer or other critical components of the spectrometer is required (e.g., other than to use the sample holder apparatus described herein).

Figure 9:
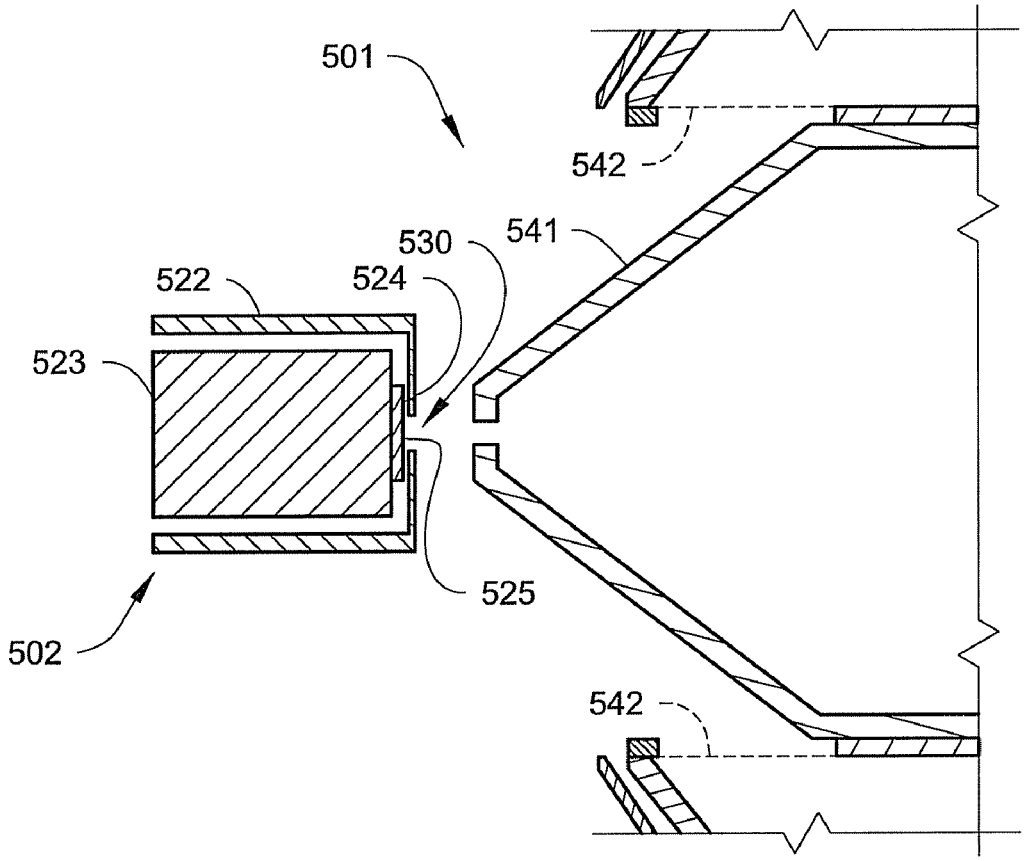
FIG. 9 is a schematic, longitudinal sectional view of a third embodiment of a sample holder apparatus and CMA.

Referring to FIG. 9, the right side of the figure depicts a coaxial CMA and electron gun 501. The left side depicts a sample holder apparatus 502 including a sample aperture member 522, sample support member 523, and sample 524. The sample aperture member 522 is electrically grounded. The sample support member 523 is electrically isolated from the sample aperture member 522 and is electrically connected to a positive bias potential (not shown). The sample 524 is mounted directly to the sample support member 523, and the two elements 523 and 524 are in electrical contact. The sample surface 525 is below the circular aperture 530 in the sample aperture member 522.

Figure 10:
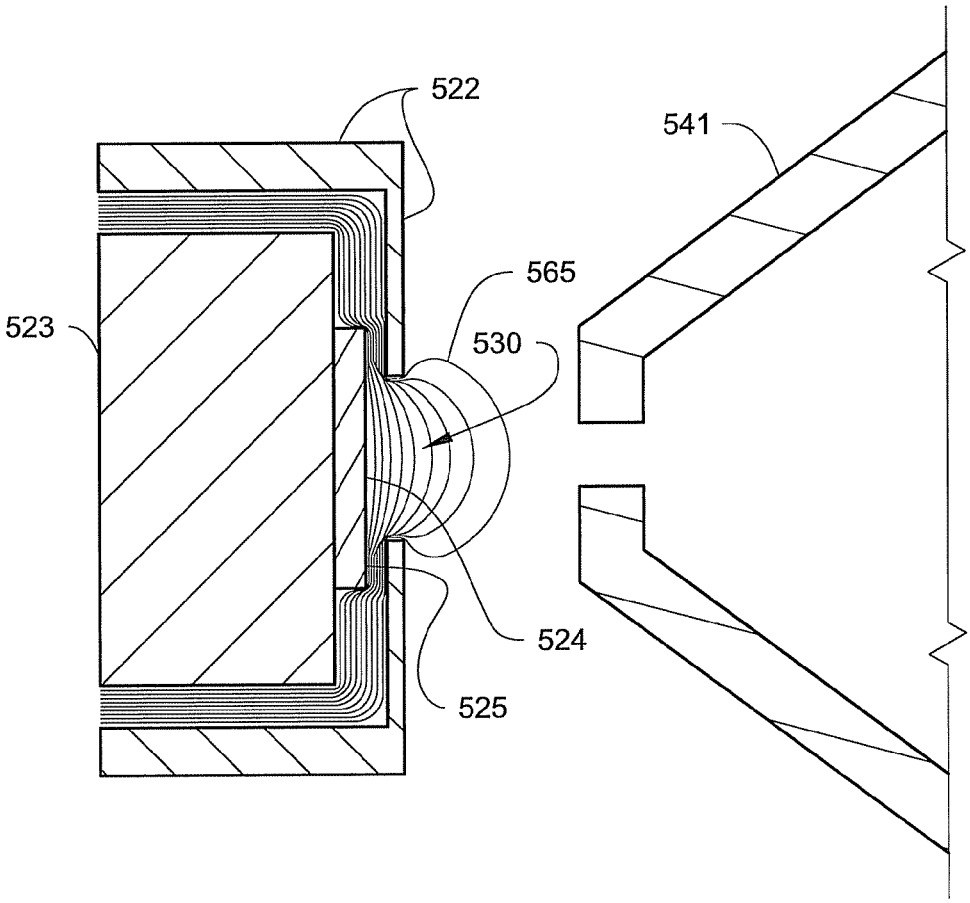
FIG. 10 is an enlarged schematic, longitudinal sectional view of a portion of the third embodiment of a sample holder apparatus and CMA including nine calculated equipotential surfaces.

Referring to FIG. 10, an enlarged view of a portion of FIG. 9 is depicted. Element 541 is the magnetic objective lens pole-piece of the coaxial electron gun and CMA 501. The sample aperture member 522 is electrically grounded. The sample support member 523 has +900 V applied. The sample 524 is mounted to the sample support member 523 and as such also has +900 V applied. The computer program SIMION 3D Version 7.0 was used to calculate nine equipotential surfaces 565 that range from +90 V to +810 V in 90 V increments. The shape of these surfaces changes from nearly planar close to the sample 524 to nearly spherical far away from the sample 524. For this embodiment, where the sample surface 525 is below the circular aperture 530 in the sample aperture member 522, the sample can have an even larger diameter than was possible in the embodiments shown in FIGS. 3-8 and still generate enough of a spherical field so that there is the proper proportion of planar to spherical field. Furthermore, the height of the aperture 530 above the sample 524 and the diameter and thickness of the circular aperture 530 are chosen to produce a planar-spherical field shape that bends the electron trajectories advantageously to fill the annular entrance of the CMA and enter the CMA 501 with the conventional range of CMA elevation angles, namely from about 36 to 48 degrees.

Figure 11:
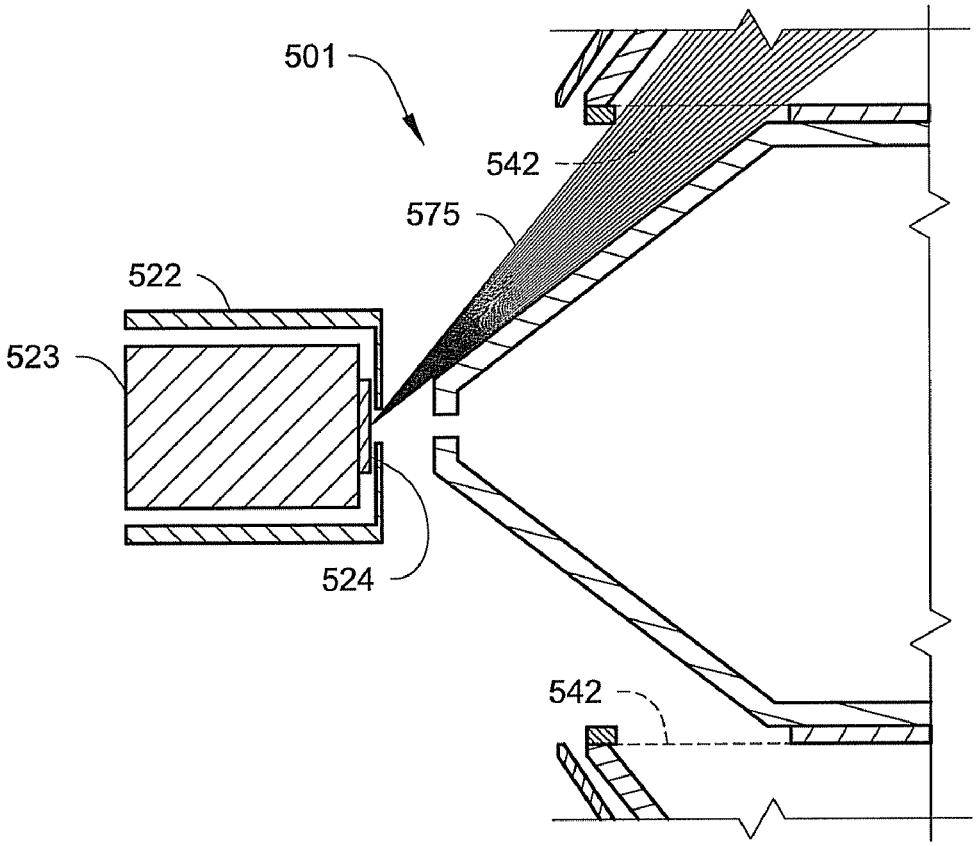
FIG. 11 is a schematic, longitudinal sectional view of the third embodiment of a sample holder apparatus and CMA including twenty-five calculated electron trajectories.

Referring to FIG. 11, operation of the embodiment of FIG. 9 is depicted. The sample aperture member 522 is electrically grounded. The sample support member 523 has +900 V applied. The sample 524 is mounted to the sample support member 523 and as such also has +900 V applied. The computer program SIMION 3D Version 7.0 was used to calculate 25 electron trajectories 575 that originate from the center of the sample 524. The trajectories were launched with 1000 eV kinetic energy and with 24 to 36 degrees elevation angle. The electrons undergo deflection near the sample as they penetrate the planar-spherical field and are slowed from 1000 eV to 100 eV kinetic energy.

Because of the shape of the planar-spherical equipotential surfaces 565 depicted in FIG. 10, the electrons are deflected advantageously to fill the CMA annular entrance or gap 542 and enter the CMA 501 with the conventional range of CMA elevation angles, namely from about 36 to 48 degrees. Because the electrons undergo a factor of 10 reduction in kinetic energy, the effective CMA resolution is increased by a factor of ten, from a native resolution of about 0.5% to an effective resolution of about 0.05%. No reduction in transmission occurs due to grid transparency or grid scattering. No modification to the analyzer or other critical components of the spectrometer is required (e.g., other than to use the sample holder apparatus described herein).

Figure 12:
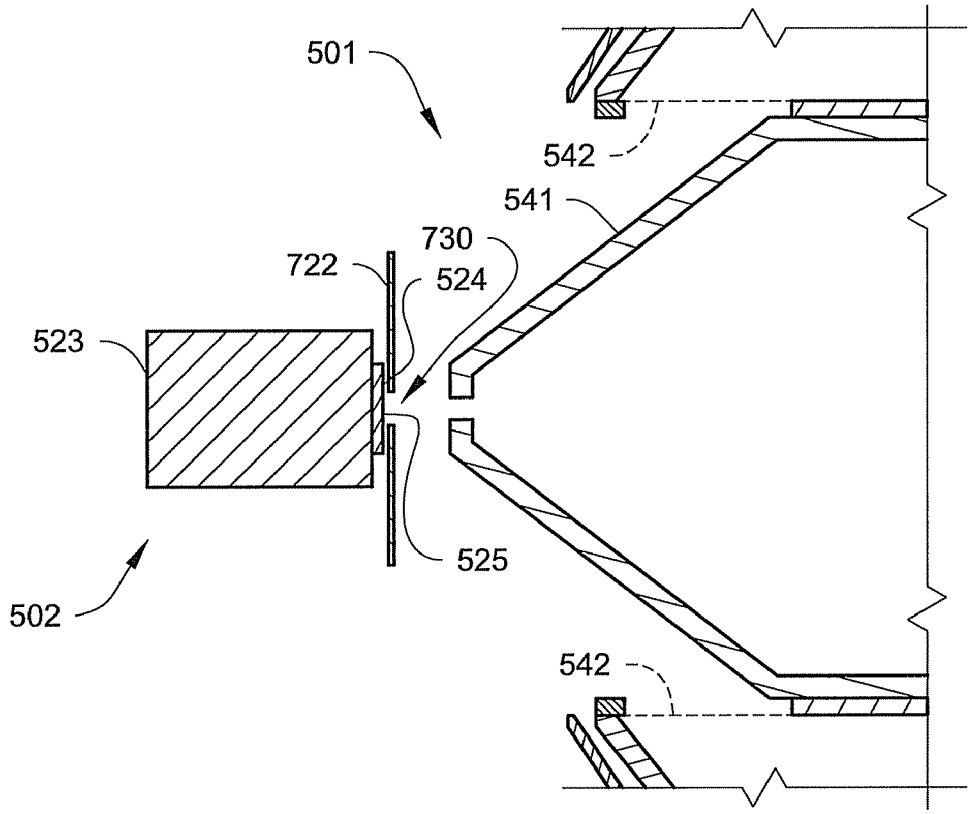
FIG. 12 is a schematic, longitudinal sectional view of a fourth embodiment of a sample holder apparatus and CMA with the sample aperture member of the sample holder apparatus in a position between the CMA and sample.

Referring to FIG. 12, the right side of the figure depicts a coaxial CMA and electron gun 501 in the same manner as in FIG. 9. The left side depicts a sample holder apparatus 502 like that shown in FIG. 9 including a sample support member 523 and sample 524. However, unlike FIG. 9, FIG. 12 includes a sample aperture member 722 that is not physically connected to the sample support member 523, but rather is separated therefrom (e.g., such as like shown in FIG. 2B). The sample aperture member 722 is electrically grounded. The sample support member 523 is electrically isolated from the sample aperture member 722 and is electrically connected to a positive bias potential (not shown). The sample 524 is mounted directly to the sample support member 523, and the two elements 523 and 524 are in electrical contact. The sample surface 525 is below the circular aperture 730 defined in the sample aperture member 722.

Figure 13:
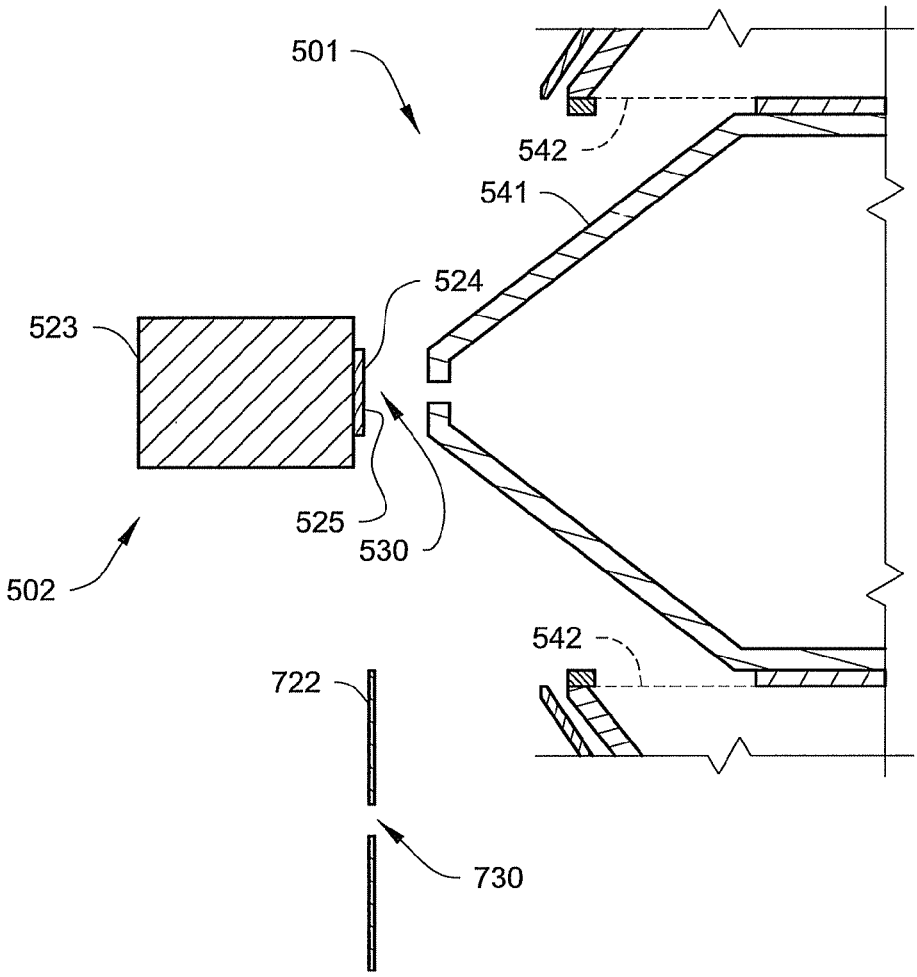
FIG. 13 is a schematic, longitudinal sectional view of the fourth embodiment of a sample holder apparatus and CMA with the sample aperture member of the sample holder apparatus in a retracted position.

The sample aperture member 722 may be mounted off of the instrument stage or off of a separate port (not shown) in the chamber (not shown) of the analysis instrument. As such, sample aperture member 722 may be centered under the analyzer and the sample would be positioned under the aperture 730. In such a manner, the sample 524 would be movable under the aperture 730 so that any area of the sample 524 can be selected for analysis. As shown in FIG. 13, the sample aperture member 722 may be retracted from its position of FIG. 12 to allow for other sample analysis/processing that may have been restricted by the presence of the aperture member 722. In other words, the sample aperture member 722 is moved out of its position between the coaxial CMA/electron gun 501 and the sample 524.

Figure 14:
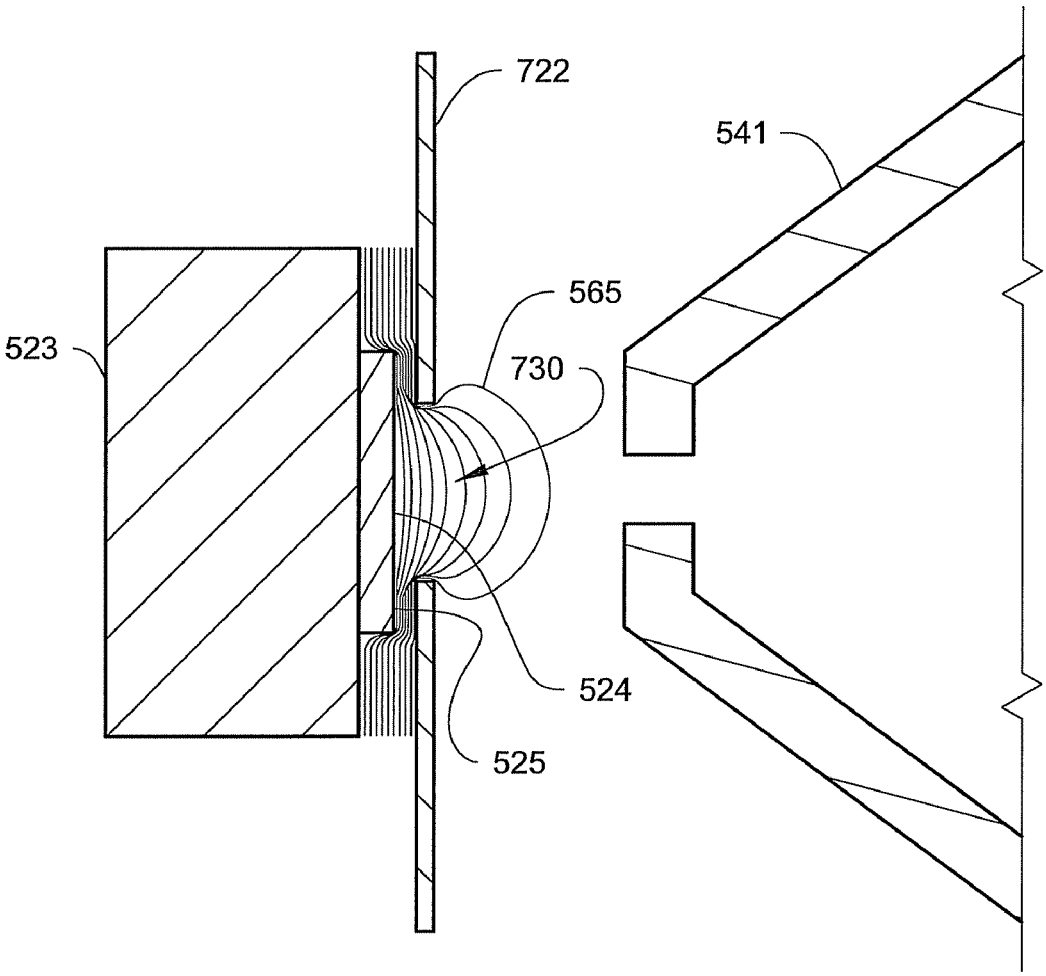
FIG. 14 is an enlarged schematic, longitudinal sectional view of a portion of the fourth embodiment of a sample holder apparatus and CMA including nine calculated equipotential surfaces.

Referring to FIG. 14, an enlarged view of a portion of FIG. 12 is depicted. Element 541 is the magnetic objective lens pole-piece of the coaxial electron gun and CMA 501. The sample aperture member 722 is electrically grounded. The sample support member 523 has +900 V applied. The sample 524 is mounted to the sample support member 523 and as such also has +900 V applied. The computer program SIMION 3D Version 7.0 was used to calculate nine equipotential surfaces 565 that range from +90 V to +810 V in 90 V increments. The shape of these surfaces changes from nearly planar close to the sample 524 to nearly spherical far away from the sample 524.

While certain embodiments have been illustrated and described, it will be apparent to those of ordinary skill in the art that various changes and modifications may be made without deviating from the concepts set forth above. Illustrative embodiments of this invention are discussed and reference has been made to possible variations within the scope of this disclosure. These and other variations, combinations, and modifications in the disclosure will be apparent to those skilled in the art without departing from the scope of the invention, and it should be understood that this invention is not limited to the illustrative embodiments set forth herein. Accordingly, the invention is to be limited only by the claims provided below and equivalents thereof.

The invention claimed is:

1. A sample holder apparatus for reducing the energy of charged particles entering an annular-acceptance analyzer, the apparatus comprising:

an electrically isolated sample support member having a sample receiving surface to receive a sample and electrically connect the sample to the sample support member, wherein the sample support member is configured for application of a retarding bias potential; and a grounded sample aperture member defining an aperture, wherein the grounded sample aperture member is positioned relative to the sample support member but electrically isolated therefrom such that the aperture is proximate the sample receiving surface to expose at least a portion of a surface of a sample received thereon to be analyzed, wherein the grounded sample aperture member along with the sample support member produce an electrical retarding field about the aperture when a retarding bias potential is applied thereto that reduces the energy of emitted particles from a sample before they enter the annular-acceptance analyzer.

2. The apparatus of claim 1, wherein the grounded sample aperture member along with the sample support member produce an electrical retarding field about the aperture when a retarding bias potential is applied thereto that reduces the energy of emitted particles from a sample before they enter the annular-acceptance analyzer and further that modifies the trajectories of such emitted particles such that they enter the annular-acceptance analyzer in a predetermined range of input elevation angles.

3. The apparatus of claim 1, wherein the retarding bias potential is a positive retarding bias potential provided by a voltage source.

4. The apparatus of claim 1, wherein the aperture is a circular aperture.

5. The apparatus of claim 1, wherein the electrically isolated sample support member comprises a body member extending along an axis terminating in the sample receiving surface configured to receive a sample, and further wherein the grounded sample aperture member comprises a wall surrounding the body member but electrically isolated therefrom, wherein the wall is terminated by an end portion defining a circular aperture, wherein the end portion is positioned relative to the sample receiving surface but electrically isolated therefrom such that the aperture is proximate the sample receiving surface to expose at least a portion of a surface of a sample received thereon to be analyzed.

6. The apparatus of claim 1, wherein the sample aperture member comprises an aperture plate defining the aperture, wherein the aperture plate is configured to allow movement between the aperture and the sample receiving surface.

7. A method for reducing the energy of charged particles entering an annular-acceptance analyzer, the method comprising:

providing an electrically isolated sample support member having a sample receiving surface to receive a sample and electrically connect the sample to the sample support member, wherein the sample support member is configured for application of a retarding bias potential;

positioning a grounded sample aperture member defining an aperture relative to the sample support member but electrically isolated therefrom such that the aperture is proximate the sample receiving surface to expose at least a portion of a surface of a sample received thereon to be analyzed; and applying a retarding bias potential to the sample support member to produce an electrical retarding field about the aperture that reduces the energy of emitted particles from a sample before they enter the annular-acceptance analyzer.

8. The method of claim 7, wherein applying a retarding bias potential to the sample support member comprises applying a retarding bias potential to the sample support member to produce an electrical retarding field about the aperture that reduces the energy of emitted particles from a sample before they enter the annular-acceptance analyzer and further that modifies the trajectories of such emitted particles such that they enter the cylindrical mirror analyzer in a predetermined range of input elevation angles.

9. The method of claim 7, wherein the electrical retarding field about the aperture comprises a planar portion proximate the surface of the sample to be analyzed and a spherical portion farther from the surface of the sample to be analyzed.

10. The method of claim 9, wherein the method further comprises controlling the relative amounts of the planar portion of electrical retarding field and spherical portion of the electrical retarding field.

11. The method of claim 7, wherein the retarding bias potential is a positive retarding bias potential.

12. The method of claim 7, wherein the electrical retarding field is confined to a region in proximity to the aperture.

13. The method of claim 7, wherein the method further comprises providing a sample on the sample receiving surface that includes a surface to be analyzed that protrudes through and above the aperture.

14. The method of claim 7, wherein the method further comprises providing a sample on the sample receiving surface that includes a surface to be analyzed that is flush with the aperture.

15. The method of claim 7, wherein the method further comprises providing a sample on the sample receiving surface that includes a surface to be analyzed that is below the aperture.

16. The method of claim 7, wherein the method further comprises moving one of the aperture defined by the grounded sample aperture member and the sample receiving surface relative to the other.

17. The method of claim 7, wherein applying a retarding bias potential to the sample support member comprises applying a retarding bias potential to the sample support member to produce an electrical retarding field about the aperture that reduces the energy of high energy emitted particles having kinetic energies greater than 3200 eV such that the energy of at least a portion of the high energy emitted particles is less than 3200 eV before they enter the annular-acceptance analyzer.

18. An analyzer system for use in analyzing a sample, wherein the system comprises:

an analyzer apparatus comprising a full or partial annular-acceptance input opening to receive emitted particles from the sample;

an electrically isolated sample support member having a sample receiving surface to receive a sample and electrically connect the sample to the sample support member, wherein the sample support member is configured for application of a retarding bias potential from a source; and a grounded sample aperture member defining an aperture, wherein at least a portion of the grounded sample aperture member is positioned between the annular-acceptance input opening of the analyzer apparatus and the sample support member such that the aperture is proximate the sample receiving surface to expose at least a portion of a surface of a sample received thereon to be analyzed, wherein the sample support member is electrically isolated from the grounded sample aperture member, and further wherein the grounded sample aperture member along with the sample support member produce an electrical retarding field about the aperture when a retarding bias potential is applied thereto that reduces the energy of emitted particles from a sample before they enter the annular-acceptance opening.

19. The system of claim 18, wherein the grounded sample aperture member along with the sample support member produce an electrical retarding field about the aperture when a retarding bias potential is applied thereto that reduces the energy of emitted particles from a sample before they enter the annular-acceptance analyzer and further that modifies the trajectories of such emitted particles such that they enter the annular-acceptance analyzer in a predetermined range of input elevation angles.

20. The system of claim 18, wherein the aperture is a circular aperture.

* * * * *